US011383534B2

(12) United States Patent
Kojima et al.

(10) Patent No.: US 11,383,534 B2
(45) Date of Patent: Jul. 12, 2022

(54) LIQUID EJECTING DEVICE AND TRANSPORTING METHOD OF TRANSPORTING BELT

(71) Applicant: SEIKO EPSON CORPORATION, Tokyo (JP)

(72) Inventors: Kenji Kojima, Fujimi-machi (JP); Masaru Jingushi, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/029,964

(22) Filed: Sep. 23, 2020

(65) Prior Publication Data

US 2021/0094322 A1 Apr. 1, 2021

(30) Foreign Application Priority Data

Sep. 26, 2019 (JP) ..... JP2019-175245

(51) Int. Cl.

| | |
|---|---|
| ***B41J 13/22*** | (2006.01) |
| ***B41J 11/00*** | (2006.01) |
| *B41J 2/01* | (2006.01) |
| *B65H 5/02* | (2006.01) |

(52) U.S. Cl.

CPC ..... *B41J 11/007* (2013.01); *B41J 13/22* (2013.01); *B41J 2/01* (2013.01); *B65H 5/021* (2013.01); *B65H 2301/4493* (2013.01); *B65H 2404/25* (2013.01); *B65H 2701/132* (2013.01)

(58) Field of Classification Search

CPC . B41J 11/007; B41J 13/22; B41J 2/01; B65H 2301/4493; B65H 2404/25; B65H 2511/222; B65H 2701/132; B65H 2801/36; B65H 5/021; B65H 16/005

See application file for complete search history.

(56) References Cited

U.S. PATENT DOCUMENTS

2016/0152051 A1* 6/2016 Ito ..... B65H 7/02 347/16

FOREIGN PATENT DOCUMENTS

| | | | | |
|---|---|---|---|---|
| JP | 2005-319721 | | 11/2005 | |
| JP | 2005319721 A | * | 11/2005 | ..... B41J 13/22 |
| JP | 2015-013455 | | 1/2015 | |
| JP | 2018-192735 | | 12/2018 | |

* cited by examiner

*Primary Examiner* — Yaovi M Ameh

(74) *Attorney, Agent, or Firm* — Workman Nydegger

(57) ABSTRACT

A liquid ejecting device includes a transporting belt configured to transport a medium, a head configured to eject a liquid onto the medium, a first gripping portion configured to grip the first end portion of the transporting belt, and move in the transport direction, and a second gripping portion configured to grip the second end portion of the transporting belt, and move in the transport direction. When the head is positioned outside the transporting belt with respect to the second end portion, the first gripping portion performs a first operation of gripping the transporting belt and moving to a predetermined position, and releasing the gripped transporting belt. When the head is positioned outside the transporting belt with respect to the first end portion, the second gripping portion performs a second operation of gripping the transporting belt and moving to a predetermined position, and releasing the gripped transporting belt.

6 Claims, 15 Drawing Sheets

LIQUID EJECTING DEVICE AND TRANSPORTING METHOD OF TRANSPORTING BELT

The present application is based on, and claims priority from JP Application Serial Number 2019-175245, filed Sep. 26, 2019, the disclosure of which is hereby incorporated by reference herein in its entirety.

BACKGROUND

1. Technical Field

The present disclosure relates to a liquid ejecting device and a transporting method of a transporting belt.

2. Related Art

There has been known a liquid ejecting device configured to form images and characters on a medium such as paper and cloth by causing an ejecting unit that ejects a liquid to be moved relative to the medium. For example, JP-A-2015-13455 discloses an inkjet recording device as a liquid ejecting device that includes two gripping portions disposed on left and right positions of a belt on which a recording medium is placed, and configured to be able to grip the belt, and that transports the medium by moving the gripping portion that grips the belt.

A micro vibration in an up-and-down direction excited by the gripping portion when the gripping portion grips the transporting belt and releases the gripped transporting belt may propagate to a printing start position of the medium supported by the transporting belt. However, since the liquid ejecting device described in JP-A-2015-13455 does not consider the vibration generated in the transporting belt at all, there has been a risk that the quality of an image printed on the medium may decrease.

SUMMARY

A liquid ejecting device includes a transporting belt configured to transport a medium in a transport direction, a head configured to move between a first end portion and a second end portion of the transporting belt in a width direction that intersects the transport direction, and eject a liquid onto the medium, a first gripping portion configured to grip the first end portion of the transporting belt, and move in the transport direction, and a second gripping portion configured to grip the second end portion of the transporting belt, and move in the transport direction, where, when the head is positioned outside the transporting belt with respect to the second end portion in the width direction, the first gripping portion performs a first operation of gripping the transporting belt and moving to a predetermined position, and releasing the gripped transporting belt, and, when the head is positioned outside the transporting belt with respect to the first end portion in the width direction, the second gripping portion performs a second operation of gripping the transporting belt and moving to a predetermined position, and releasing the gripped transporting belt.

The liquid ejecting device described above may further include a first detection unit configured to detect a displacement of the first gripping portion, and a second detection unit configured to detect a displacement of the second gripping portion, where the transporting belt may be transported based on a detection result of the first detection unit or the second detection unit.

In the liquid ejecting device described above, the first operation and the second operation may be alternately performed.

A transporting method of a transporting belt is a transporting method of a transporting belt of a liquid ejecting device including the transporting belt configured to transport a medium in a transport direction, a head configured to move between a first end portion and a second end portion of the transporting belt in a width direction that intersects the transport direction, and eject a liquid onto the medium supported by the transporting belt, a first gripping portion configured to grip the first end portion of the transporting belt, and move in the transport direction, and a second gripping portion configured to grip the second end portion of the transporting belt, and move in the transport direction, and includes a first operation step in which, when the head is positioned outside the transporting belt with respect to the second end portion in the width direction, the first gripping portion grips the transporting belt and moves to a predetermined position, and releases the gripped transporting belt, and a second operation step in which, when the head is positioned outside the transporting belt with respect to the first end portion in the width direction, the second gripping portion grips the transporting belt and moves to a predetermined position, and releases the gripped transporting belt.

DESCRIPTION OF EXEMPLARY EMBODIMENTS

Figure 1:
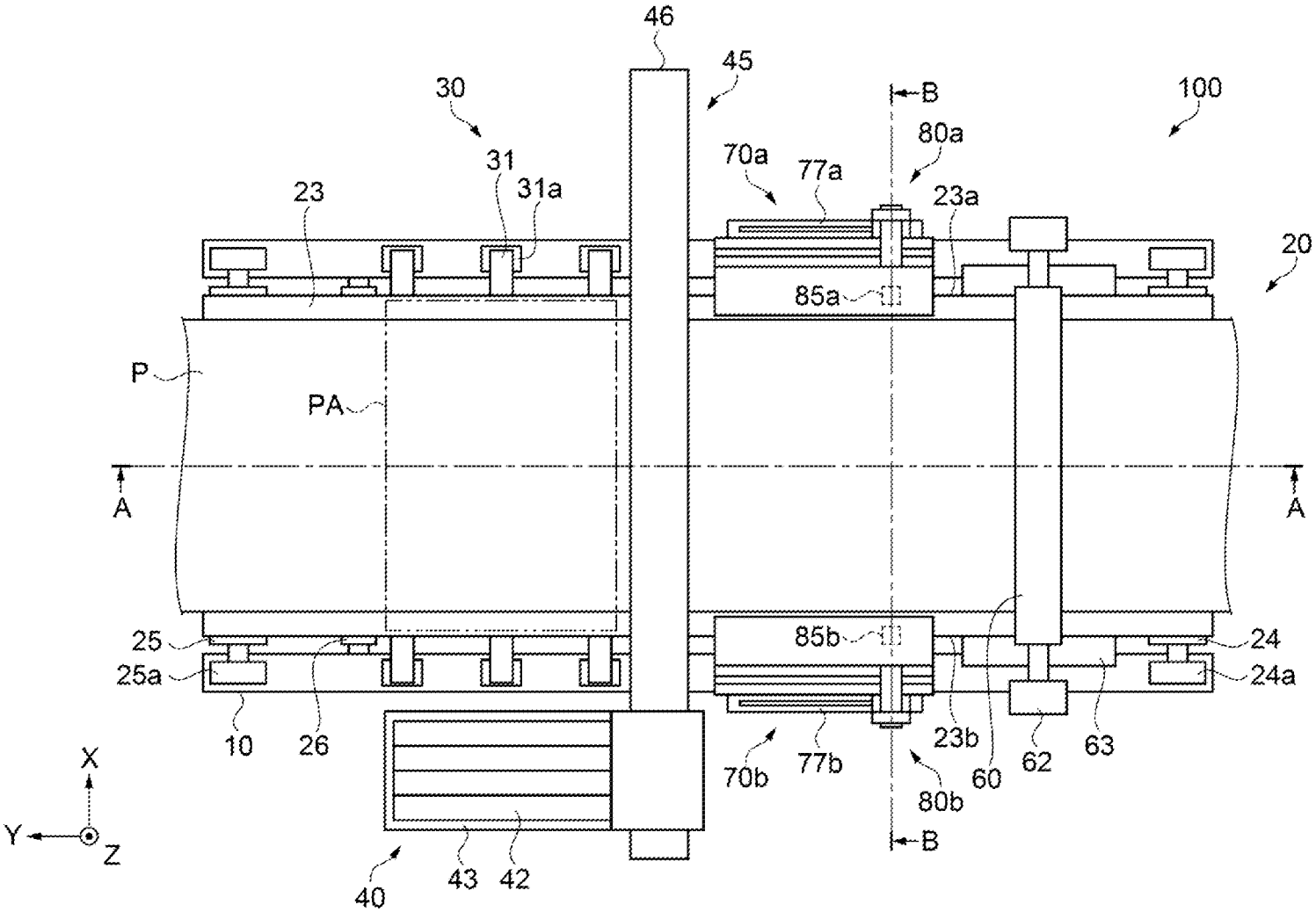
FIG. 1 is a plan view illustrating a whole configuration of a liquid ejecting device according to Exemplary Embodiment 1.

Exemplary embodiments will be described below with reference to the accompanying drawings. Note that, in coordinates provided in the drawings, both directions along a Z-axis are an up-and-down direction, an arrow direction is "up", a Y-axis corresponds to a transport direction, and an arrow direction is "downstream" direction. Further, an X-axis corresponds to a width direction that intersects the transport direction. Further, a tip end side of the arrow indicating each of the axes is defined as a "plus side" and a base end side is defined as a "negative side".

1. Exemplary Embodiment 1

1-1. Configuration of Liquid Ejecting Device

Figure 2:
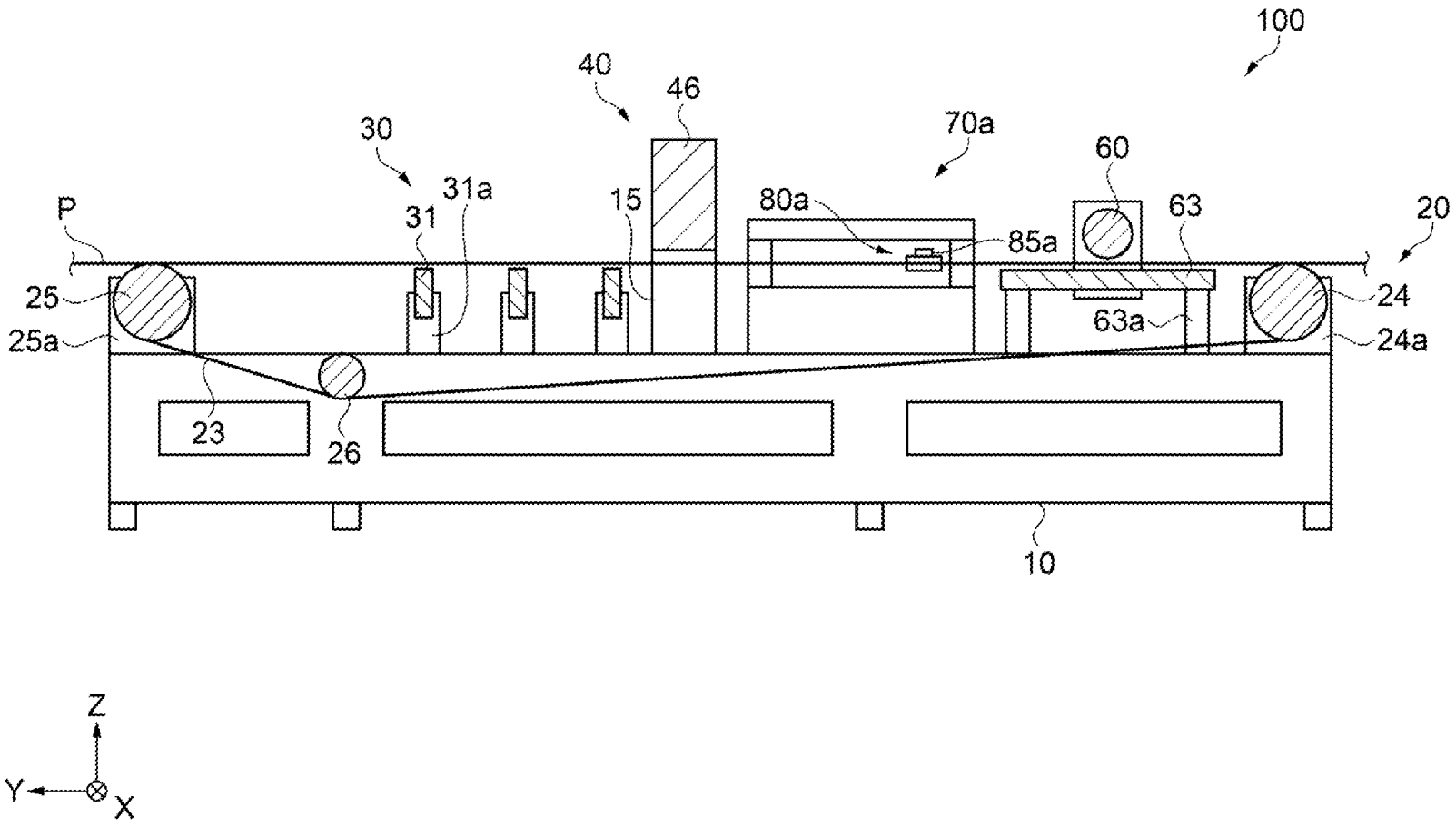
FIG. 2 is a cross-sectional side view taken along a line A-A in FIG. 1.

FIG. 1 is a plan view illustrating a whole configuration of a liquid ejecting device according to Exemplary Embodiment 1. FIG. 2 is a cross-sectional side view taken along a line A-A in FIG. 1. A liquid ejecting device 100 is configured to perform printing on a medium P by moving a head 42 in a width direction of the medium P supported by a transporting belt 23 and ejecting a liquid onto the medium P.

As illustrated in FIG. 1, the liquid ejecting device 100 includes a transport unit 20 and a printing unit 40. Each of the units of the liquid ejecting device 100 is attached to a frame 10.

First, a configuration of the transport unit 20 will be described below.

The transport unit 20 includes the frame 10, the transporting belt 23, a first roller 24, a second roller 25, a third roller 26, a medium support portion 30, a pressing unit 60, a first belt displacement measuring unit 70*a*, a second belt displacement measuring unit 70*b*, a first gripping portion 80*a*, a second gripping portion 80*b*, and the like. The transport unit 20 is configured to transport the medium P in the transport direction. As the medium P, there can be used, for example, natural fiber, cotton, silk, hemp, mohair, wool, cashmere, regenerated fiber, synthetic fiber, nylon, polyurethane, polyester, and woven cloth or non-woven cloth fabricated by mixed spinning of these fibers. To the woven cloth or non-woven cloth, a pretreatment agent for promoting a color developing property and a fixing property may be applied.

The frame 10 forms a rectangular parallelepiped having the Y-axis as a longitudinal direction in which a plurality of frame members are combined with each other. The first roller 24 is disposed upstream of the frame 10 in the transport direction. Both ends of the first roller 24 are rotatably supported on a support stage 24*a*, where the support stage 24*a* is attached to an upper surface of the frame 10. Further, the second roller 25 is disposed downstream of the frame 10 in the transport direction. The second roller 25 is rotatably supported on a support stage 25*a*, where the support stage 25*a* is attached to the upper surface of the frame 10.

The transporting belt 23 is stretched over the first roller 24 and the second roller 25, and rotates while supporting the medium P to transport the medium P in the transport direction. More specifically, the transporting belt 23 is endlessly formed with both end portions of a band-shaped belt being coupled to each other, and is hung between two rollers of the first roller 24 and the second roller 25. The transporting belt 23 is held in a state where a predetermined tension is applied thereto.

A front surface of the transporting belt 23 is provided with an adhesive layer onto which the medium P adheres. The transporting belt 23 supports the medium P bonded to the adhesive layer by the pressing unit 60 described below. This allows stretchable clothes and the like to be handled as the medium P.

The first roller 24 and the second roller 25 are provided at an inner side of the transporting belt 23, and support a back surface of the transporting belt 23. The transport unit 20 in the present exemplary embodiment includes the third roller 26 that supports the transporting belt 23 between the first roller 24 and the second roller 25. The third roller 26 is a member that assists in supporting the transporting belt 23, with an aim to adjust the tension of the transporting belt 23 and the like. Note that the transport unit 20 may also be configured not to include a member such as the third roller 26 that assists in supporting the transporting belt 23.

The medium support portion 30 is provided at the inner side of the transporting belt 23 and between the first roller 24 and the second roller 25. The medium support portion 30 is a beam member 31 having a beam shape elongated in the width direction of the medium P that intersects the transport direction, and a length of the beam member 31 is longer than a width of the transporting belt 23. Both ends of the beam member 31 constituting the medium support portion 30 are supported by a support stage 31*a* attached onto the frame 10. The medium support portion 30 supports the transporting belt 23 in a printing area PA illustrated in FIG. 1 from below with three beam members 31. The printing area PA is an area of the transporting belt 23 that overlaps the head 42 in a plan view from the Z-axis when a carriage 43 constituting the printing unit 40 described below moves in the width direction. Note that the present exemplary embodiment exemplifies a configuration in which the transporting belt 23 in the printing area PA is supported by the three beam members 31, but the number of the beam members 31 may be two, or four or more, and the beam member 31 may be a plate member having a plate shape.

The pressing unit 60 is provided on an upstream side of the printing region PA, and presses the medium P supplied on the transporting belt 23 toward a pressing unit support portion 63. The pressing unit 60 is formed in a cylindrical shape or a columnar shape, is provided rotatably in a circumferential direction, and rotates along the transport direction of the medium P. The pressing unit 60 is supported to be reciprocally movable along the transport direction. The pressing unit 60 is moved by a pressing unit driving portion 62 in the transport direction and in a direction opposite to the transport direction while pressing the medium P downward from above along the Z-axis.

The pressing unit support portion 63 is provided at the inner side of the transporting belt 23 and between the first roller 24 and the medium support portion 30. The pressing unit support portion 63 has a plate shape and is configured to be able to support the pressing unit 60 via the transporting belt 23. A range in which the pressing unit support portion 63 is formed corresponds to a movement range of the pressing unit 60. Specifically, a length of the pressing unit support portion 63 along the X-axis corresponds to a length of the pressing unit 60 along the X-axis, and a length of the pressing unit support portion 63 along the Y-axis corresponds to a movement range of the pressing unit 60 along the Y-axis. The pressing unit support portion 63 is supported by four support stages 63*a* attached to the upper surface of the frame 10. The medium P supplied on the front surface of the transporting belt 23 is pressed against the transporting belt 23 between the pressing unit 60 and the pressing unit support portion 63. This allows the medium P to reliably adhere onto the adhesive layer provided on the front surface of the transporting belt 23, and to prevent the medium P from floating up over the transporting belt 23. Note that the transporting belt may be of an electrostatic adsorption type belt for adsorbing the medium P with static electricity.

Figure 3:
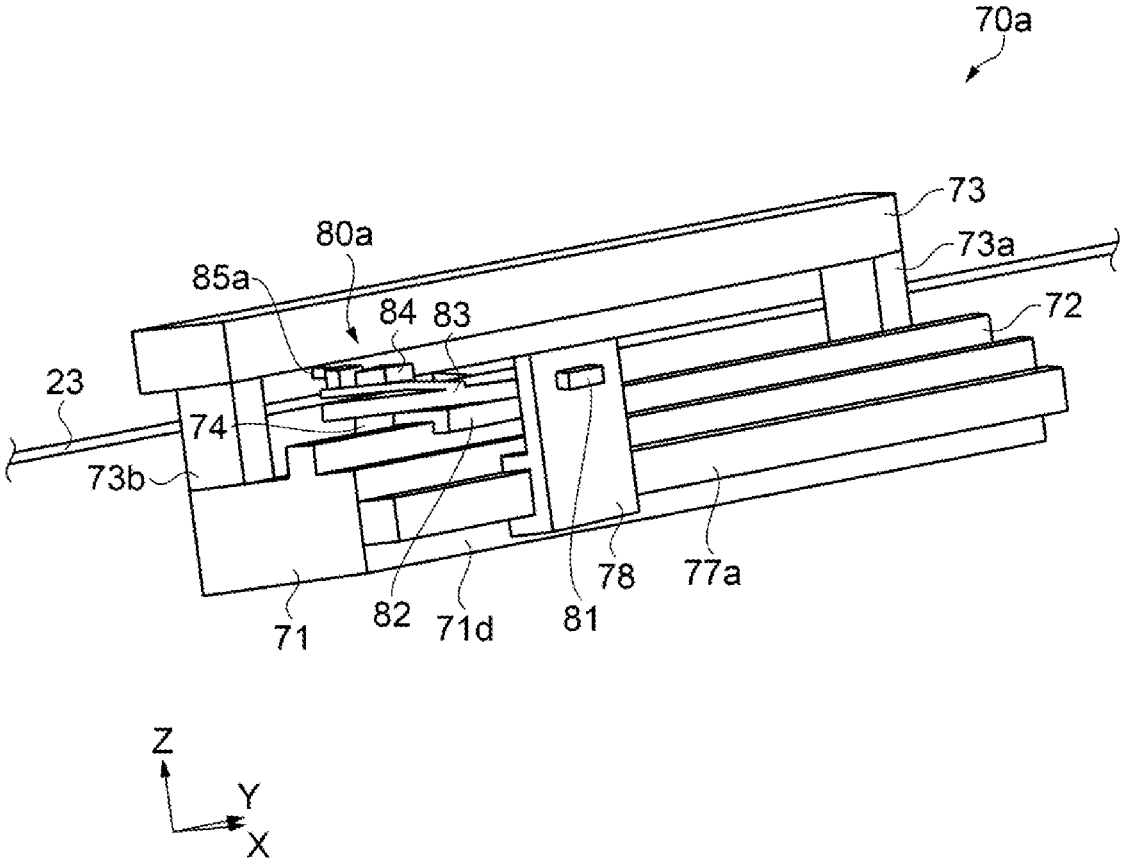
FIG. 3 is a perspective view illustrating a configuration of a first belt displacement measuring unit.
Figure 4:
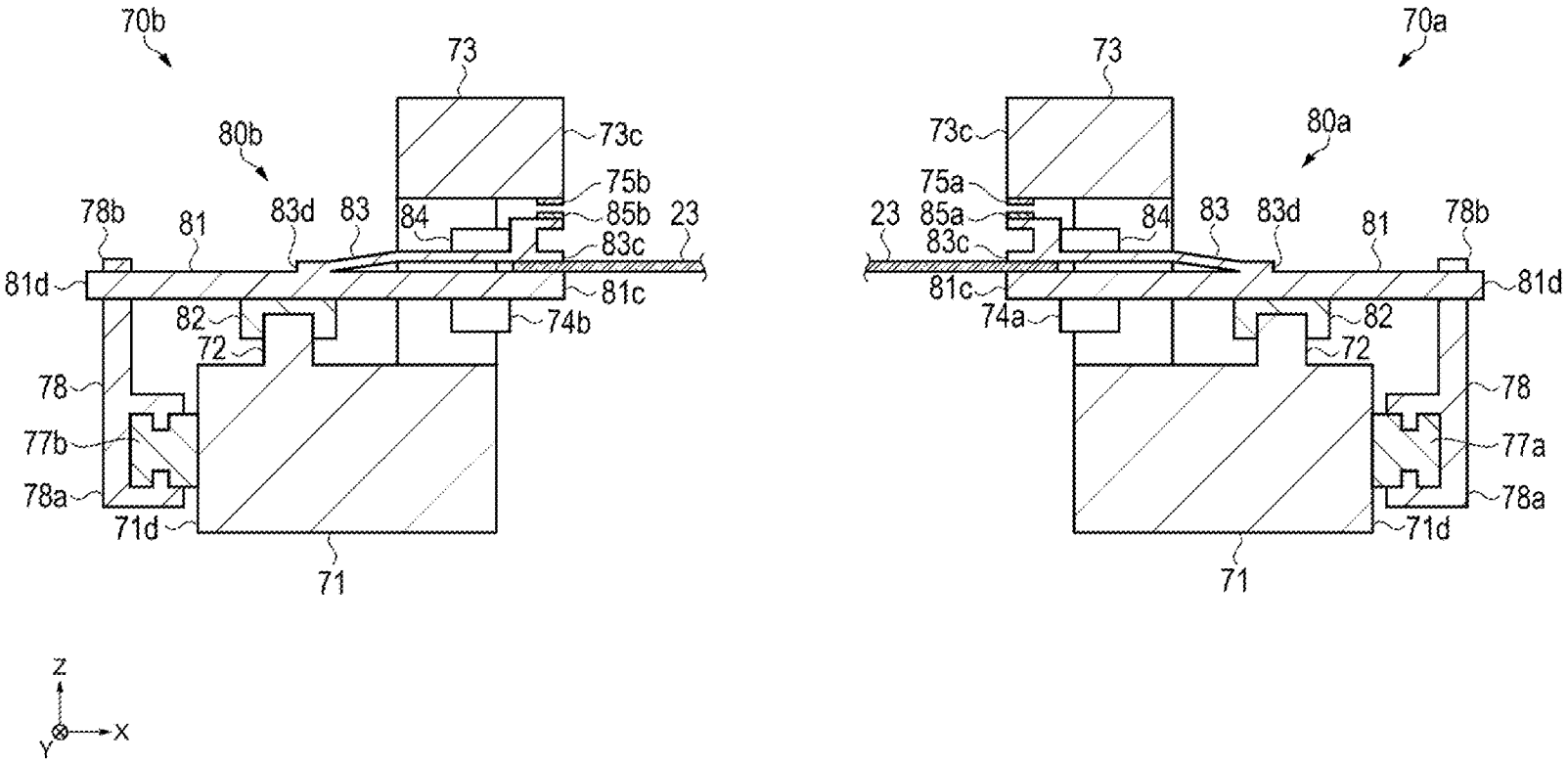
FIG. 4 is a cross-sectional view taken along a line B-B in FIG. 1.

FIG. 3 is a perspective view illustrating a configuration of the first belt displacement measuring unit. FIG. 4 is a cross-sectional view taken along a line B-B in FIG. 1. Note that the second belt displacement measuring unit 70*b* is configured to be symmetrical to the first belt displacement measuring unit 70*a* with respect to a center line of the transporting belt 23 in the width direction that intersects the transport direction. Thus, an illustration of a perspective view illustrating a configuration of the second belt displacement measuring unit 70*b* will be omitted.

The first belt displacement measuring unit 70*a* is provided on the upstream side of the printing unit 40, and is positioned on a positive side of the transporting belt 23 along the X-axis.

The first belt displacement measuring unit 70*a* includes a first scale portion 75*a* provided along the transport direction, a first detection unit 85*a* that detects a displacement relative to the first scale portion 75*a*, and the first gripping portion 80*a* that is configured so as to integrally move with the first detection unit 85*a*, grips an end portion on the positive side along the X-axis that is a first end portion 23*a* of the transporting belt 23 in the width direction, and moves with the transporting belt 23 in the transport direction. The first detection unit 85*a* detects the displacement of the first gripping portion 80*a*, namely, the displacement of the transporting belt 23 at the first end portion 23*a*.

The first belt displacement measuring unit 70*a* includes a base 71 having a rectangular parallelepiped form elongated along the transport direction of the medium P, a scale bonded portion 73 provided above the base 71, the first gripping portion 80*a* that is provided on the base 71 and moves along a guide rail 72 extending along the Y-axis, a first movement mechanism 77*a* for moving the first gripping portion 80*a* in both directions along the transport direction, and the like.

The scale bonded portion 73 spans between column portions 73*a* and 73*b* provided perpendicularly to both ends of the base 71 along the Y-axis being a longitudinal direction. The scale bonded unit 73 in the first belt displacement measuring unit 70*a* includes a protruding portion that protrudes in an eaves shape on a negative side along the X-axis, and a part thereof overlaps the transporting belt 23 in the plan view.

The first scale portion 75*a* is provided on a lower surface of the protruding portion of the scale bonded portion 73. A magnetic scale in which magnets having different polarities are alternately disposed is used in the first scale portion 75*a* according to the present exemplary embodiment.

The first gripping portion 80*a* includes a gripping base 81, a guide block 82, an elastic member 83, and the like. The gripping base 81 has a rectangular plate shape elongated in the width direction of the transporting belt 23. An end portion 81*c* of the gripping base 81 on the negative side along the X-axis substantially coincides with a side wall 73*c* of the scale bonded portion 73 on the negative side along the X-axis in the plan view, and overlaps the transporting belt 23. An end portion 81*d* of the gripping base 81 on the positive side along the X-axis protrudes more than a side wall 71*d* of the base 71 on the positive side along the X-axis in the plan view. The guide block 82 is provided on a bottom surface of the gripping base 81. A recessed groove that corresponds to a shape of the guide rail 72 protruding in a protruding shape from an upper surface of the base 71, and opens to a negative side along the Z-axis in a side view from the Y-axis is formed in the guide block 82. With the guide block 82 and the guide rail 72 engaging each other, the first gripping portion 80*a* is configured to be reciprocally movable along the transport direction.

The elastic member 83 is provided on an upper surface of the gripping base 81. The elastic member 83 has a rectangular plate shape shorter than the gripping base 81. An end portion 83*d* of the elastic member 83 on the positive side along the X-axis is bonded to the gripping base 81 substantially at the center of the gripping base 81. An end portion 83*c* of the elastic member 83 on the negative side along the X-axis substantially coincides with the end portion 81*c* of the gripping base 81 on the negative side along the X-axis in the plan view. The end portion 81*c* of the gripping base 81 and the end portion 83*c* of the elastic member 83 have a slightly wider gap than a thickness of the transporting belt 23. The first gripping portion 80*a* is configured to be able to grip the first end portion 23*a* of the transporting belt 23 between the end portion 81*c* of the gripping base 81 and the end portion 83*c* of the elastic member 83 by an elastic force of the elastic member 83. Carbon fiber and the like can be used as a material of the elastic member 83.

The first gripping portion 80*a* includes a ferromagnetic body 84 on the upper surface of the elastic member 83 that does not overlap the transporting belt 23 in the plan view. Iron, nickel, cobalt, and the like can be used as the ferromagnetic body 84.

Further, a first switching unit 74*a* that switches the first gripping portion 80*a* between a gripping state and a non-gripping state is provided at a position on a lower surface of the gripping base 81 of the first gripping portion 80*a*, and facing the ferromagnetic body 84. The switching unit 74 includes an electromagnet and a driving portion, and the ferromagnetic body 84 is attracted to the first switching portion 74*a* by a magnetic force generated when a current is passed through the electromagnet by the driving portion. At this time, the elastic member 83 elastically deforms toward the gripping base 81, resulting in the gripping state in which the transporting belt 23 is gripped between the gripping base 81 and the elastic member 83 by the elastic force. Further, when the current passing through the electromagnet is cut off, the first gripping portion 80*a* is brought into the non-gripping state from the gripping state.

The first detection unit 85*a* is provided at a position on the upper surface of the end portion 83*c* of the elastic member 83, and facing the first scale portion 75*a*. The first detection unit 85*a* includes a hall element, an MR element, or the like configured to convert a change in a magnetic field into an electrical signal, and detects the displacement relative to the first scale portion 75*a*. The first detection unit 85*a* according to the present exemplary embodiment is provided on a pedestal for disposing the first detection unit 85*a* close to the first scale portion 75*a*. The first detection unit 85*a* integrally moves with the first gripping portion 80*a*.

The first movement mechanism 77*a* moves the first gripping portion 80*a* in the gripping state in the transport direction, and moves the first gripping portion 80*a* in the non-gripping state in the direction opposite to the transport direction via a movement lever 78 that couples the gripping base 81 of the first gripping portion 80*a* to the first movement mechanism 77*a*. The first movement mechanism 77*a* has a rectangular parallelepiped shape elongated in the transport direction, and is fixed to the side wall 71*d* of the base 71 on the positive side along the X-axis. A recessed guide groove extending in the transport direction is formed in an upper surface and a lower surface of the first movement mechanism 77*a*.

The movement lever 78 includes a pedestal 78*a* including a protruding protrusion that corresponds to a shape of the guide groove, and a long handle portion 78*b* extending from the pedestal 78*a* along the Z-axis. An upper end of the long handle portion 78*b* is coupled to the gripping base 81. The movement lever 78 is configured to be reciprocally movable along the Y-axis with the guide groove of the first movement mechanism 77*a* and the pedestal 78*a* engaging each other. As the first moving mechanism 77*a*, there can be employed, for example, a mechanism combined of a ball screw and a ball nut, a linear guide mechanism, or the like. As the driving portion that drives the first moving mechanism 77*a*, there can be employed, for example, a variety of motors such as a stepping motor, a servomotor, and a linear motor or an air cylinder.

The second belt displacement measuring unit 70*b* is provided on the upstream side of the printing unit 40, and is positioned on the negative side of the transporting belt 23 along the X-axis.

The second belt displacement measuring unit 70*b* includes a second scale portion 75*b* provided along the transport direction, a second detection unit 85*b* that detects a displacement relative to the second scale portion 75*b*, and the second gripping portion 80*b* that is configured so as to integrally move with the second detection unit 85*b*, grips an end portion on the negative side along the X-axis that is a second end portion 23*b* of the transporting belt 23 in the width direction, and moves with the transporting belt 23 in the transport direction. The second detection unit 85*b* detects the displacement of the second gripping portion 80*b*, namely, the displacement of the transporting belt 23 at the second end portion 23*b*. Further, a second switching unit 74*b* that switches the second gripping portion 80*b* between the gripping state and the non-gripping state is provided at the second gripping portion 80*b*.

The second belt displacement measuring unit 70*b* includes a base 71 having a rectangular parallelepiped form elongated along the transport direction of the medium P, a scale bonded portion 73 provided above the base 71, a second movement mechanism 77*b* for moving the second gripping portion 80*b* in both directions along the transport direction, and the like.

The second belt displacement measuring unit 70*b* is configured to be symmetrical to the first belt displacement measuring unit 70*a* in the width direction. The second gripping portion 80*b*, the second scale portion 75*b*, the second detection unit 85*b*, the second movement mechanism 77*b*, and the second switching unit 74*b* included in the second belt displacement measuring unit 70*b* have the same configuration as that of the respective corresponding components of the first belt displacement measuring unit 70*a*, and thus description of the configuration will be omitted.

Note that the present exemplary embodiment indicates the configuration in which the first and second detection units 85*a* and 85*b* integrally move with the first and second gripping portions 80*a* and 80*b*, and the first and second scale portions 75*a* and 75*b* are fixed, but a configuration in which the first and second scale portions integrally move with the first and second gripping portions, and the first and second detection units are fixed may be used.

Further, the present exemplary embodiment exemplifies a so-called magnetic encoder that obtains a relative displacement between the first scale portion 75*a* and the first detection unit 85*a* and a relative displacement between the second scale portion 75*b* and the second detection unit 85*b* through a change in magnetic field, but an optical encoder that obtains the displacement through an optical change may also be used.

The configuration of the transport unit 20 is described above. Note that the transport unit 20 may also be configured to be able to be coupled to a medium supply unit that supplies the medium P at the upstream of the transporting belt 23 in the transport direction. For example, the medium supply unit rotatably supports the medium P of a band-shape wound in a rolled shape, rolls out the medium P of a rolled shape by rotating the medium P, and then supplies the medium P to the transporting belt 23. Further, the transport unit 20 may also be configured to be able to be coupled to a medium winding unit that winds up the medium P at the downstream of the transporting belt 23 in the transport direction. For example, the medium winding unit includes a winding shaft that rotatably supports the medium P, and rotates the winding shaft to wind up the medium P of a band-shape into a rolled shape.

Next, a configuration of the printing unit 40 will be described. The printing unit 40 includes the head 42, the carriage 43, a carriage moving unit 45, and the like.

The printing unit 40 is disposed above the transport unit 20. The head 42 ejects the liquid onto the medium P supported by the transporting belt 23 to print an image and the like on the medium P. A plurality of the heads 42 are mounted on the carriage 43 in a replaceable manner. The head 42 mounted on the carriage 43 moves between the first end portion 23*a* and the second end portion 23*b* of the transporting belt 23 in the width direction by the carriage moving unit 45. Each of the heads 42 is supplied with, as the liquid, a color ink such as cyan (C), magenta (M), yellow (Y), black (K), and the like, a preprocess liquid, postprocess liquid, or the like. The head 42 includes a piezoelectric element as a driving portion configured to eject the liquid from a nozzle corresponding to each liquid toward the medium P positioned in the printing region PA.

The carriage moving unit 45 is attached to a support frame 15 extending from the frame 10 to the positive side along the Z-axis, and is positioned above the transporting belt 23. The carriage moving unit 45 includes a guide rail 46 extending along the X-axis. The head 42 is supported by the guide rail 46 in a state reciprocally movable with the carriage 43 along the X-axis.

The carriage moving unit 45 includes a moving mechanism for causing the carriage 43 to move along the guide rail 46, and a driving portion that drives the moving mechanism. As the moving mechanism, there can be employed, for example, a mechanism combined of a ball screw and a ball nut, a linear guide mechanism, or the like. As the driving portion, there can be employed, for example, a variety of motors such as a stepping motor, a servomotor, and a linear motor. The motor is driven to cause the moving mechanism to move the head 42 together with the carriage 43 along the X axis direction.

Figure 5:
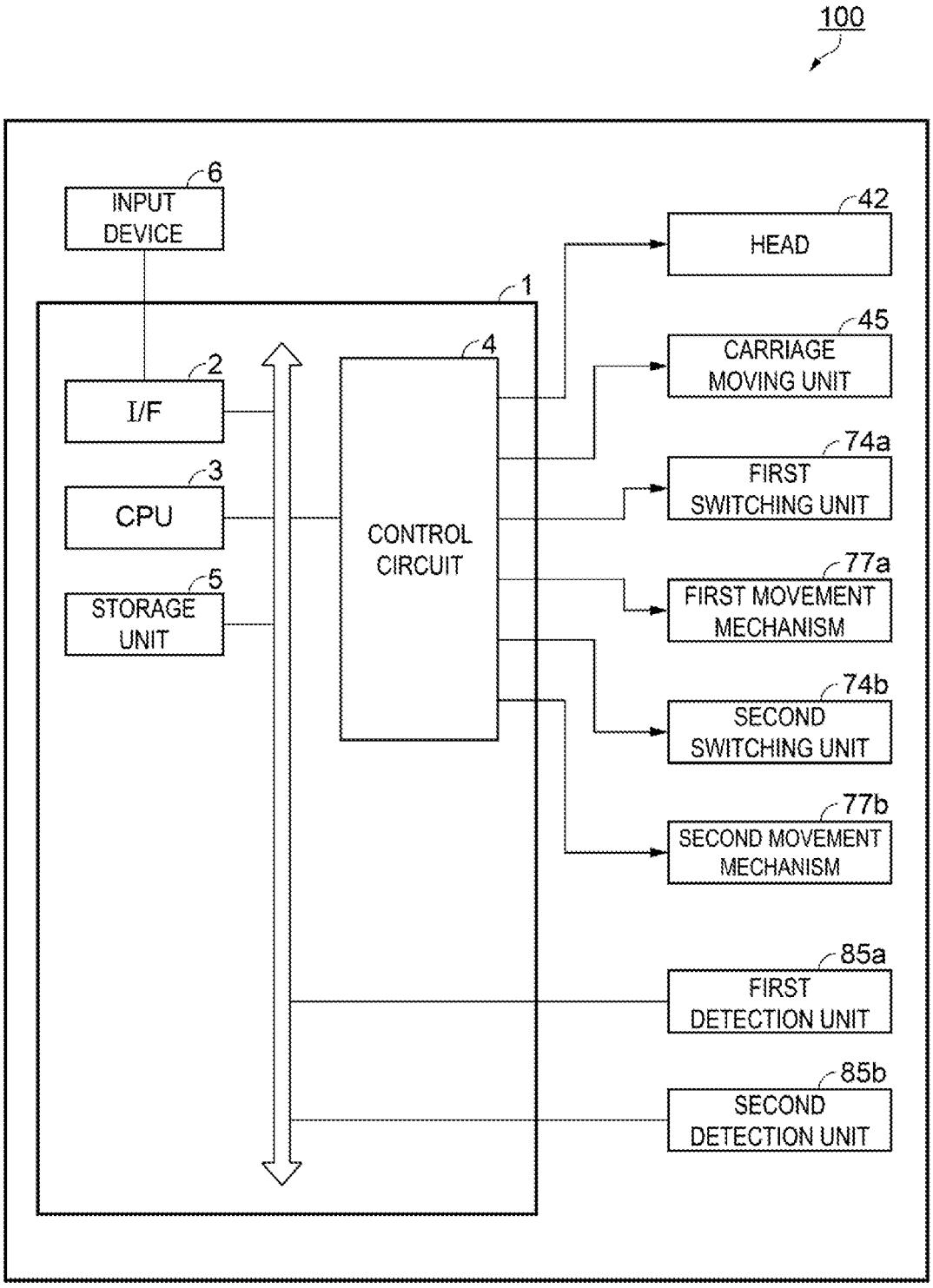
FIG. 5 is a block diagram illustrating electrical coupling of the liquid ejecting device.

FIG. 5 is a block diagram illustrating electrical coupling of the liquid ejecting device. Next, an electrical configuration of the liquid ejecting device 100 will be described with reference to FIG. 5.

The liquid ejecting device 100 includes a control unit 1 that controls each component included in the liquid ejecting device 100. The control unit 1 is configured to include an interface (I/F) unit 2, a Central Processing Unit (CPU) 3, a control circuit 4, a storage unit 5, and the like. The CPU 3 is coupled to each component via a bus.

The I/F unit 2 is coupled to an input device 6, is configured to transmit/receive data between the input device 6 that handles an input signal and an image and the control unit 1, and receives print data and the like generated in the input device 6. The input device 6 is constituted by a computer and the like. In the present exemplary embodiment, a block diagram in which the input device 6 is integrally formed with the liquid ejecting device 100 is illustrated, but the input device 6 may be separately formed from the liquid ejecting device 100.

The CPU 3 is an arithmetic processing device for performing various types of input signal processing, and an overall control of the liquid ejecting device 100 in accordance with a program stored in the storage unit 5 and the print data received from the input device 6.

The storage unit 5 serves as a storage medium configured to secure a region for storing the program, a working region, and the like of the CPU 3, and includes a storage element such as a Random Access Memory (RAM), an Electrically Erasable Programmable Read Only Memory (EEPROM), or the like. The control circuit 4 is a circuit coupled to each driving portion of the head 42, the carriage moving unit 45, the first switching unit 74*a*, the first movement mechanism 77*a*, the second switching unit 74*b*, and the second movement mechanism 77*b*, and configured to generate a control signal for controlling the driving of the head 42, the carriage moving unit 45, the first switching unit 74*a*, the first movement mechanism 77*a*, the second switching unit 74*b*, the second movement mechanism 77*b*, and the like, based on the print data and the arithmetic result of the CPU 3.

Further, the CPU 3 is coupled to the first detection unit 85*a* and the second detection unit 85*b* via the bus. The CPU 3 calculates the displacement of the first gripping portion 80*a* moved by the first movement mechanism 77*a*, based on a detection result output from the first detection unit 85*a*, and calculates the displacement of the second gripping portion 80*b* moved by the second movement mechanism 77*b*, based on a detection result output from the second detection unit 85*b*.

The control unit 1 generates a first current control signal for controlling a driving portion that generates a magnetic force in the first switching unit 74*a*. The first switching unit 74*a* switches the first gripping portion 80*a* between the gripping state and the non-gripping state, based on the first current control signal.

The control unit 1 generates a first movement mechanism control signal for controlling the driving portion of the first movement mechanism 77*a*, based on the calculated displacement of the first gripping portion 80*a*, and performs feedback control of the first movement mechanism 77*a*. In other words, the transporting belt 23 is transported based on a detection result of the first detection unit 85*a*.

For example, the control unit 1 performs a first operation in which the first gripping portion 80*a* grips the transporting belt 23 and moves to a predetermined position in the transport direction, and releases the gripped transporting belt 23 by the control of the first switching unit 74*a* by the first current control signal and the control of the first movement mechanism 77*a* by the first movement mechanism control signal.

The control unit 1 generates a second current control signal for controlling a driving portion that generates a magnetic force in the second switching unit 74*b*. The second switching unit 74*b* switches the second gripping portion 80*b* between the gripping state and the non-gripping state, based on the second current control signal.

The control unit 1 generates a second movement mechanism control signal for controlling the driving portion of the second movement mechanism 77*b*, based on the calculated displacement of the second gripping portion 80*b*, and performs feedback control of the second movement mechanism 77*b*. In other words, the transporting belt 23 is transported based on a detection result of the second detection unit 85*b*.

For example, the control unit 1 performs a second operation in which the second gripping portion 80*b* grips the transporting belt 23 and moves to a predetermined position in the transport direction, and releases the gripped transporting belt 23 by the control of the second switching unit 74*b* by the second current control signal and the control of the second movement mechanism 77*b* by the second movement mechanism control signal.

The control unit 1 performs an image forming operation of generating a head control signal for controlling the driving portion of the head 42 and a carriage control signal for controlling the driving portion of the carriage moving unit 45, ejecting the liquid droplet to the medium P by causing the head 42 moved by the carriage 43 to eject the liquid.

The control unit 1 causes any one of the first operation and the second operation, and the image forming operation to be alternately performed, and thus an image based on the image data is printed on the medium P.

1-2. Transporting Method in Bidirectional Printing

Figure 6:
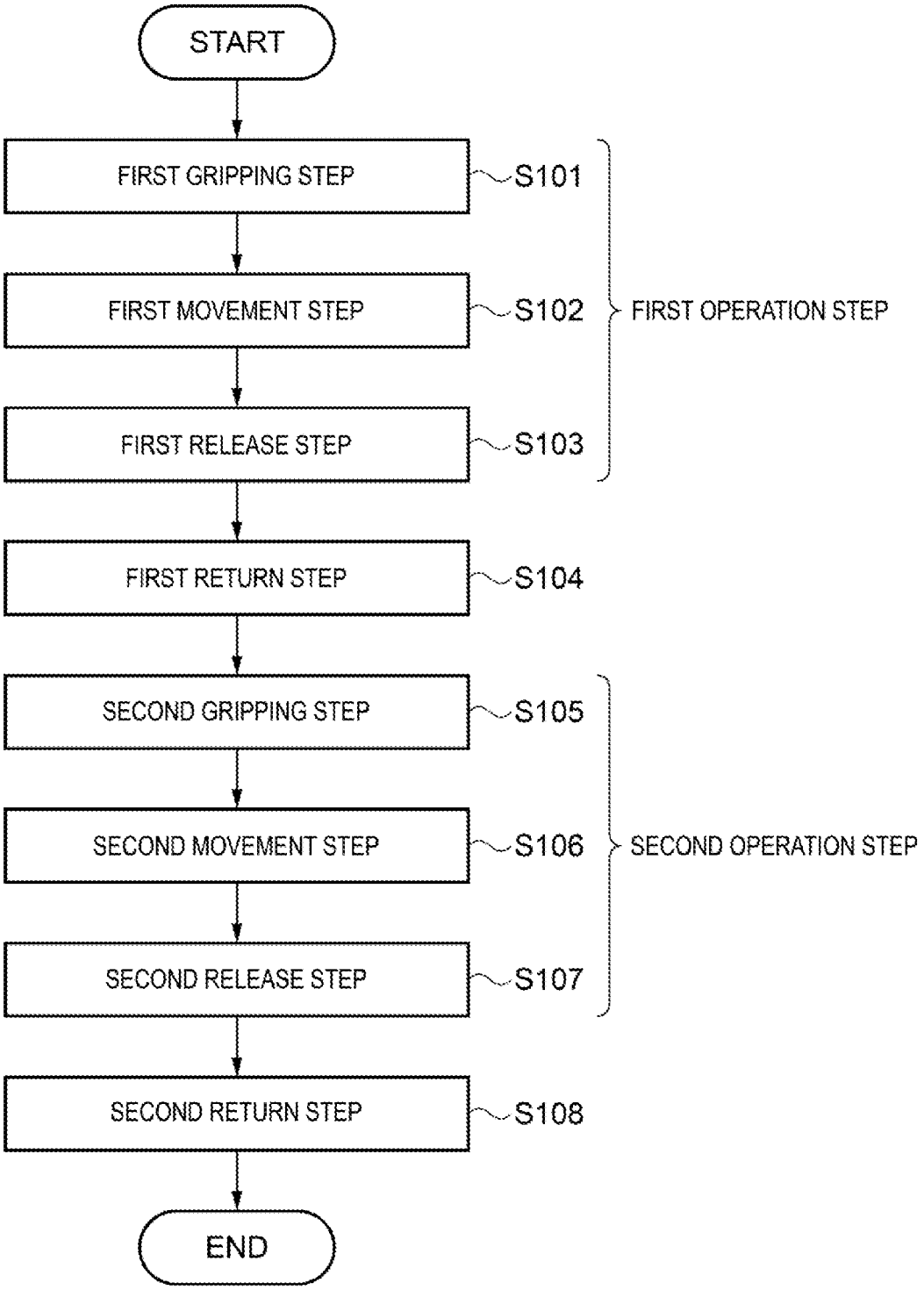
FIG. 6 is a flowchart diagram illustrating a transporting method of a transporting belt in bidirectional printing.

FIG. 6 is a flowchart diagram illustrating the transporting method of the transporting belt in the bidirectional printing. FIGS. 7 to 10 are diagrams illustrating a positional relationship between the gripping portion and the head in each step of the transporting method. Next, the transporting method of the transporting belt 23 in the bidirectional printing of the liquid ejecting device 100 will be described with reference to FIGS. 6 to 10.

Figure 7:
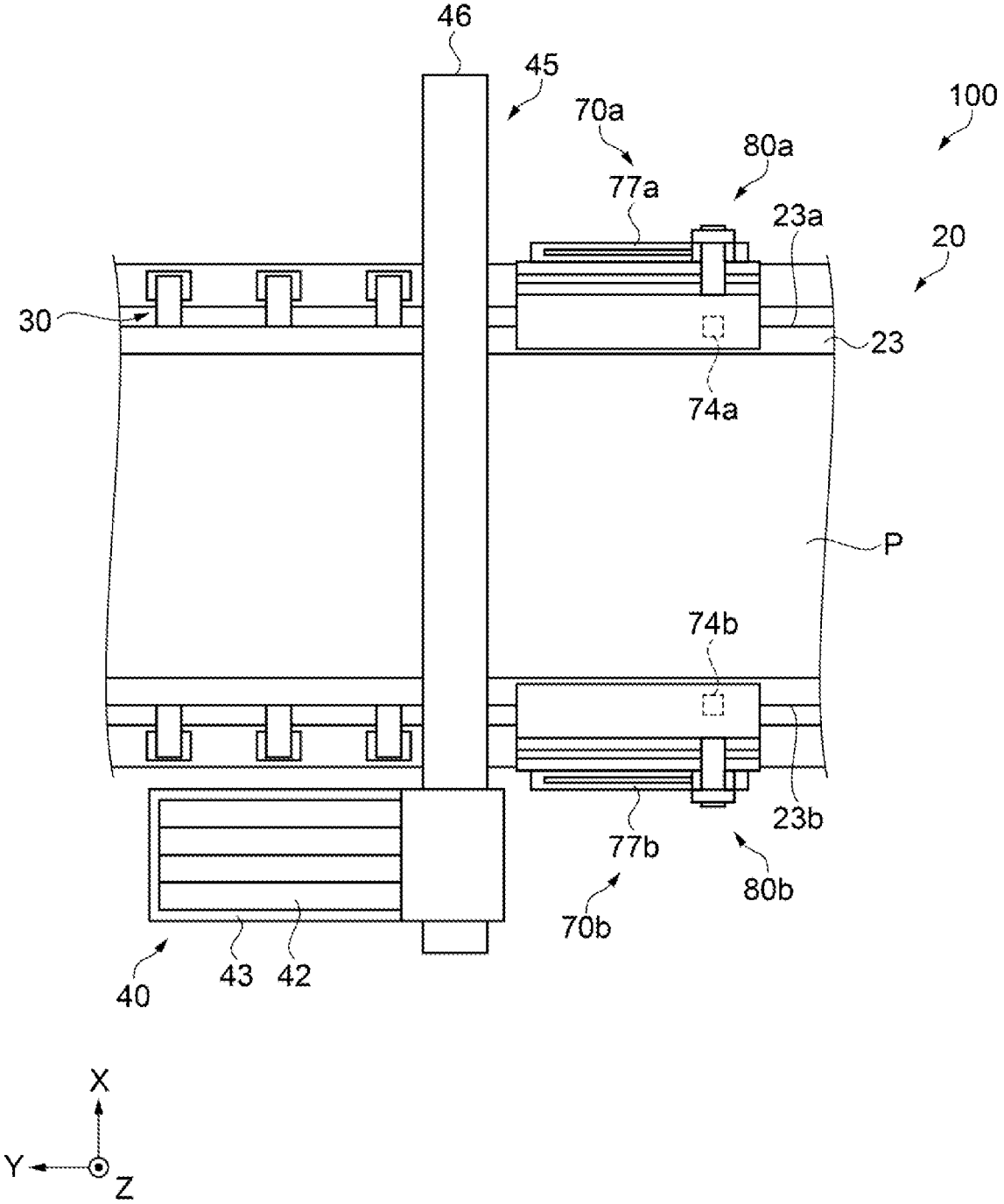
FIG. 7 is a diagram illustrating a positional relationship between a gripping portion and a head in each step of the transporting method.

Step S101 is a first gripping step of gripping the transporting belt 23 by the first gripping portion 80*a*. As illustrated in FIG. 7, when the head 42 is positioned outside the transporting belt 23 with respect to the second end portion 23*b* in the width direction, the control unit 1 generates the magnetic force in the first switching unit 74*a*, and brings the first gripping portion 80*a* in the non-gripping state into the gripping state of gripping the first end portion 23*a* of the transporting belt 23. At this time, a micro vibration in the up-and-down direction is excited on the transporting belt 23 from the first end portion 23*a* gripped by the first gripping portion 80*a*.

Figure 8:
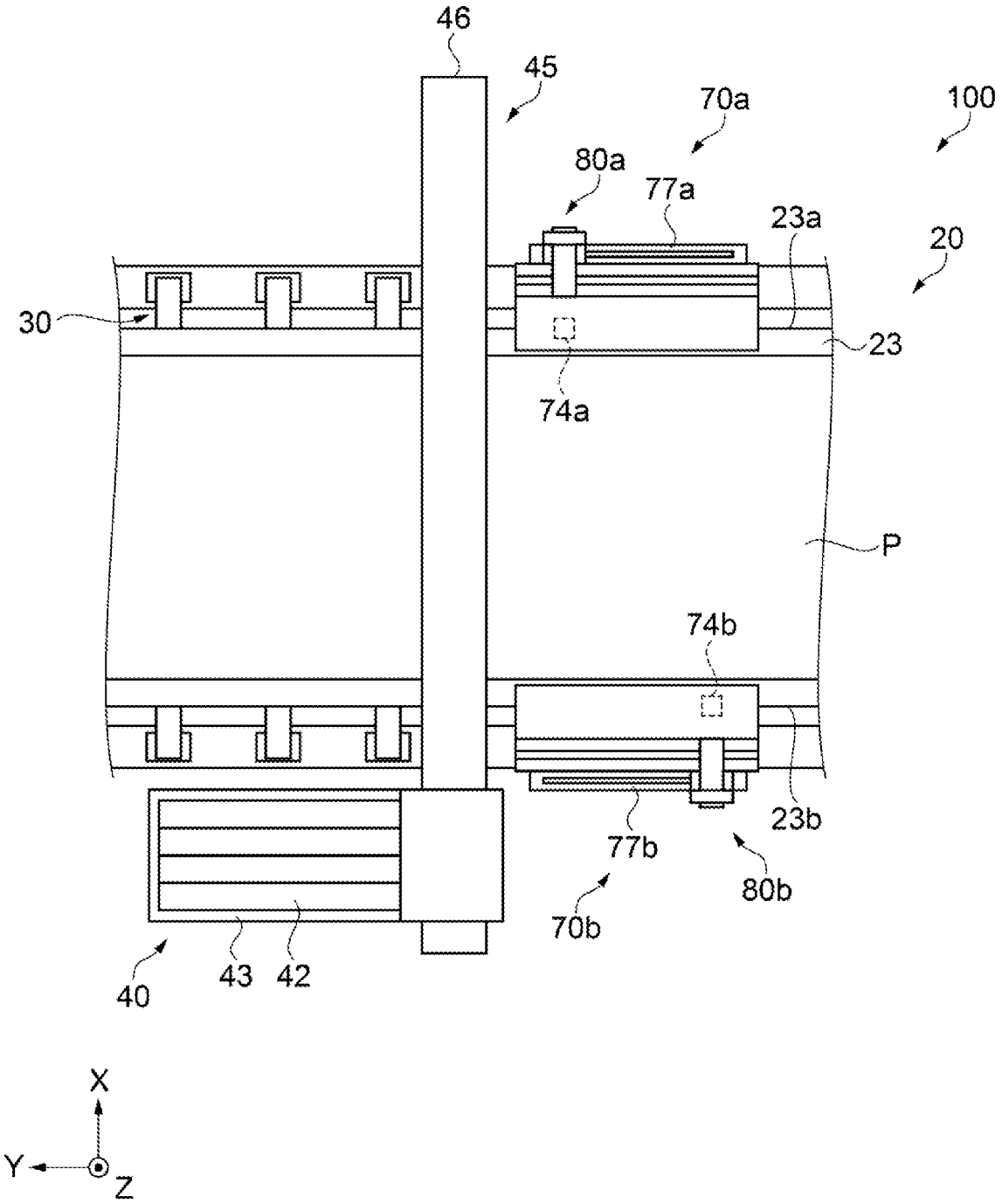
FIG. 8 is a diagram illustrating a positional relationship between the gripping portion and the head in each step of the transporting method.

Step S102 is a first movement step of moving the first gripping portion 80*a* in the gripping state in the transport direction. As illustrated in FIG. 8, the control unit 1 drives the first movement mechanism 77*a*, and moves the first gripping portion 80*a* in the gripping state of gripping the transporting belt 23 from upstream to downstream in the transport direction to a predetermined position. The transporting belt 23 is transported in the transport direction together with the first gripping portion 80*a*, and the medium P on the transporting belt 23 is transported to a predetermined position based on print data.

Step S103 is a first release step of releasing the gripped first gripping portion 80*a*. The control unit 1 demagnetizes the magnetic force of the first switching unit 74*a*, and brings the first gripping portion 80*a* in the gripping state into the non-gripping state in which the transporting belt 23 is not gripped. At this time, a micro vibration in the up-and-down direction is excited on the transporting belt 23 from the first end portion 23*a* that has been gripped by the first gripping portion 80*a*.

Note that step S101 to step S103 are a first operation step of performing the first operation in which the first gripping portion 80*a* grips the transporting belt 23 and moves to the predetermined position, and releases the gripped transporting belt 23.

Figure 9:
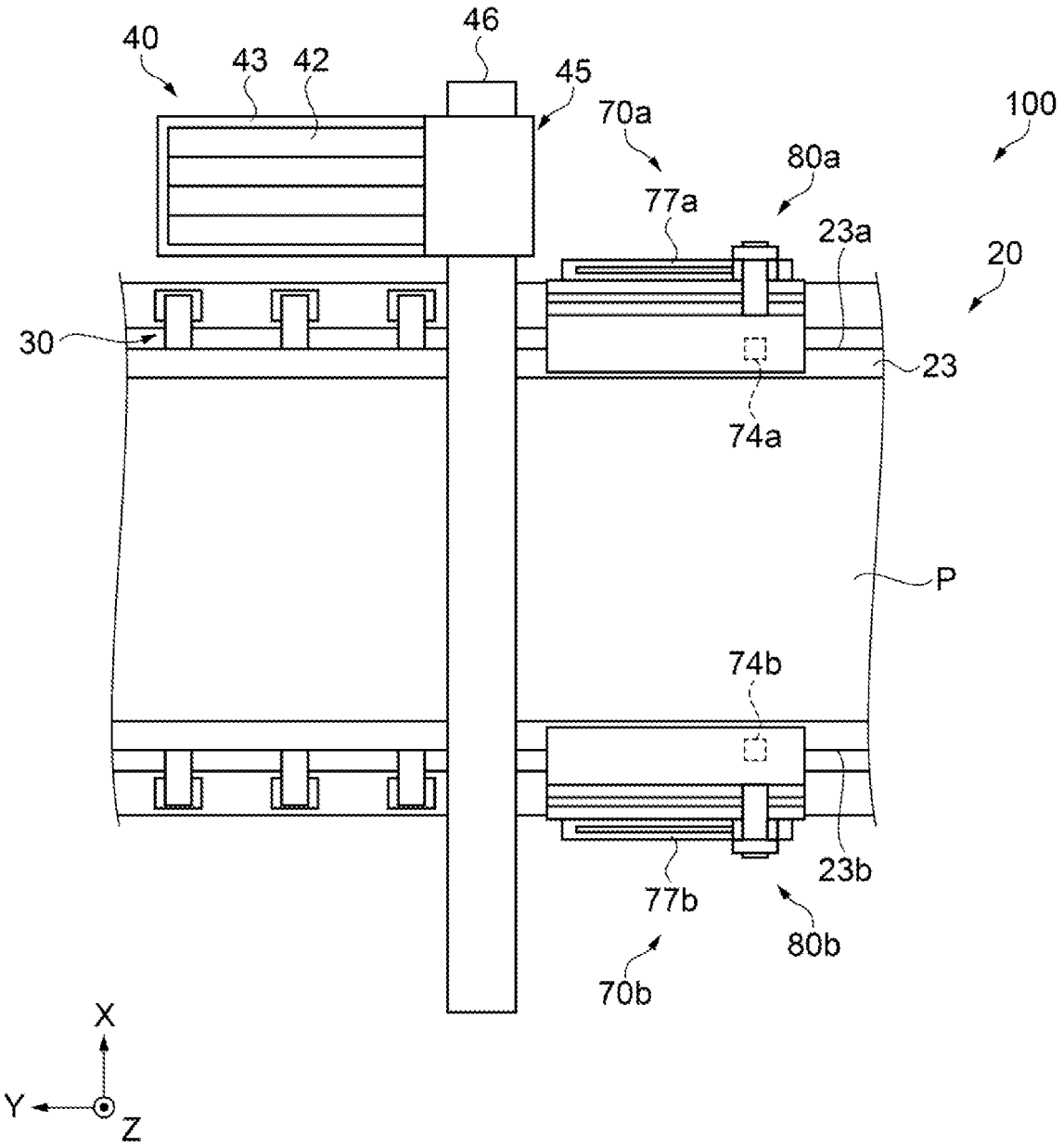
FIG. 9 is a diagram illustrating a positional relationship between the gripping portion and the head in each step of the transporting method.

Step S104 is a first return step of moving the first gripping portion 80*a* in the non-gripping state in the direction opposite to the transport direction. As illustrated in FIG. 9, the control unit 1 drives the first movement mechanism 77*a*, and moves the first gripping portion 80*a* in the non-gripping state from downstream to upstream in the transport direction to the original position.

Note that, in step S104, the control unit 1 controls the head 42 and the carriage moving unit 45, based on the print data, and performs the image forming operation of causing the head 42 to eject the liquid while moving the carriage 43 from the second end portion 23*b* side to the first end portion 23*a* side of the transporting belt 23. The image forming operation may start simultaneously with step S103 or may start between step S104 and step S105. As illustrated in FIG. 8, the micro vibration generated in step S101 and step S103 is excited at the first end portion 23*a* away from the head 42 positioned on the second end portion 23*b* side that is the printing start position of the image forming operation. The micro vibration propagating through the transporting belt 23 is attenuated before reaching the printing start position.

Step S105 is a second gripping step of gripping the transporting belt 23 by the second gripping portion 80*b*. As illustrated in FIG. 9, when the head 42 is positioned outside the transporting belt 23 with respect to the first end portion 23*a* in the width direction, the control unit 1 generates the magnetic force in the second switching unit 74*b*, and brings the second gripping portion 80*b* in the non-gripping state into the gripping state of gripping the second end portion 23*b* of the transporting belt 23. At this time, a micro vibration in the up-and-down direction is excited on the transporting belt 23 from the second end portion 23*b* gripped by the second gripping portion 80*b*.

Figure 10:
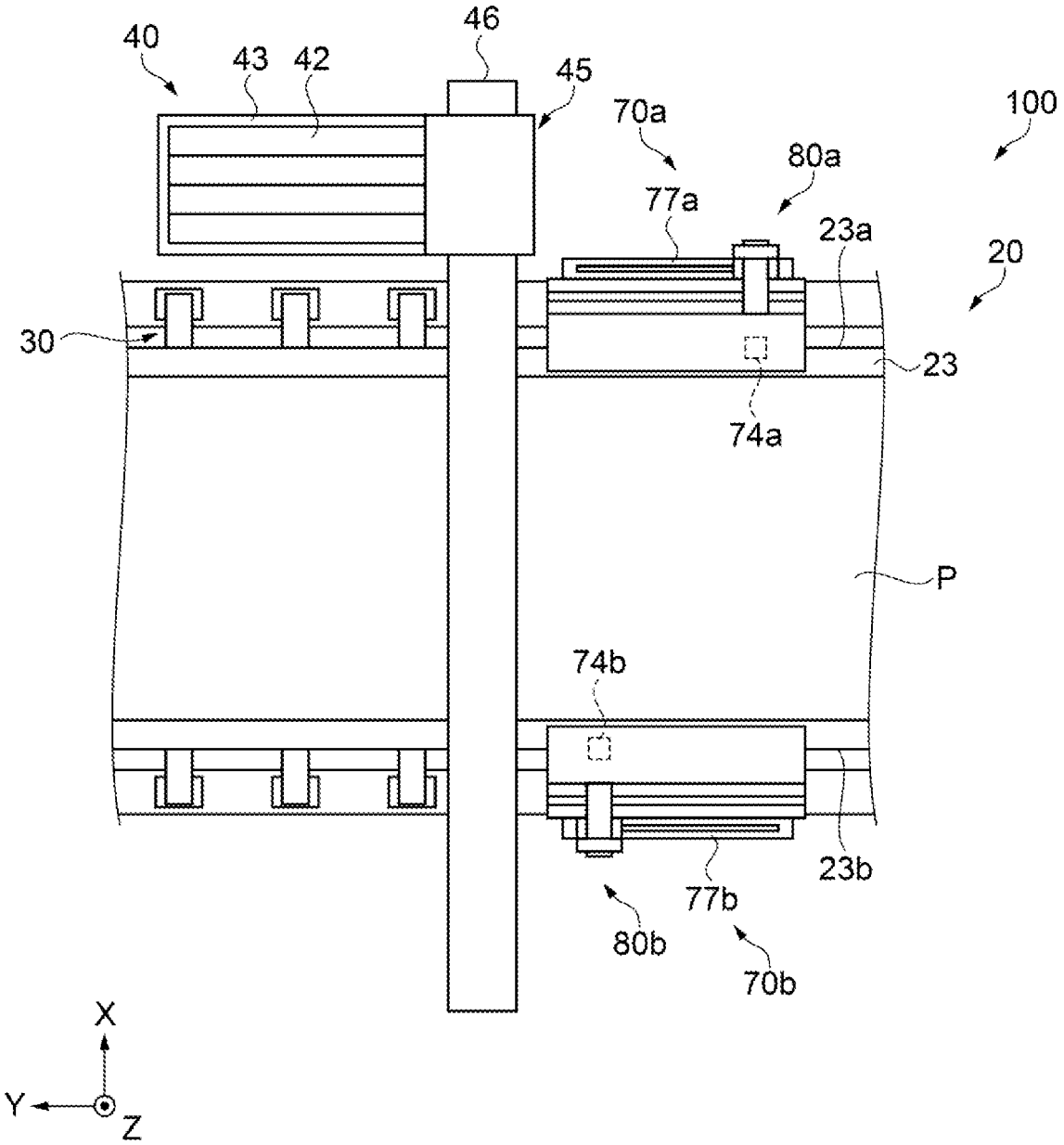
FIG. 10 is a diagram illustrating a positional relationship between the gripping portion and the head in each step of the transporting method.

Step S106 is a second movement step of moving the second gripping portion 80*b* in the gripping state in the transport direction. As illustrated in FIG. 10, the control unit 1 drives the second movement mechanism 77*b*, and moves the second gripping portion 80*b* in the gripping state of gripping the transporting belt 23 from upstream to downstream in the transport direction to a predetermined position. The transporting belt 23 is transported in the transport direction together with the second gripping portion 80*b*, and the medium P on the transporting belt 23 is transported to a predetermined position based on the print data.

Step S107 is a second release step of releasing the gripped second gripping portion 80*b*. The control unit 1 demagnetizes the magnetic force of the second switching unit 74*b*, and brings the second gripping portion 80*b* in the gripping state into the non-gripping state in which the transporting belt 23 is not gripped. At this time, a micro vibration in the up-and-down direction is excited on the transporting belt 23 from the second end portion 23*b* that has been gripped by the second gripping portion 80*b*.

Note that step S105 to step S107 are a second operation step of performing the second operation in which the second gripping portion 80*b* grips the transporting belt 23 and moves to the predetermined position, and releases the gripped transporting belt 23.

Step S108 is a second return step of moving the second gripping portion 80*b* in the non-gripping state in the direction opposite to the transport direction. As illustrated in FIG. 7, the control unit 1 drives the second movement mechanism 77*b*, and moves the second gripping portion 80*b* in the non-gripping state from downstream to upstream in the transport direction to the original position.

Note that, in step S108, the control unit 1 controls the head 42 and the carriage moving unit 45 based on the print data, and performs the image forming operation of causing the head 42 to eject the liquid while moving the carriage 43 from the first end portion 23*a* side to the second end portion 23*b* side of the transporting belt 23. The image forming operation may start simultaneously with step S107 or may start between step S108 and step S101 when step S101 to step S108 are repeatedly performed. As illustrated in FIG. 9, the micro vibration generated in step S105 and step S107 is excited at the second end portion 23*b* away from the head 42 positioned on the first end portion 23*a* side that is the printing start position of the image forming operation. The micro vibration propagating through the transporting belt 23 is attenuated before reaching the printing start position.

Step S101 to step S108 are repeatedly performed, and the first operation by the first gripping portion 80*a* and the second operation by the second gripping portion 80*b* are alternately performed, and thus the transporting belt 23 is sequentially transported in the transport direction. The control unit 1 sequentially performs the image forming operation by the bidirectional printing on the medium P transported by the transporting belt 23, and thus a desired image is formed on the medium P.

1-3. Transporting Method in Unidirectional Printing

Figure 11:
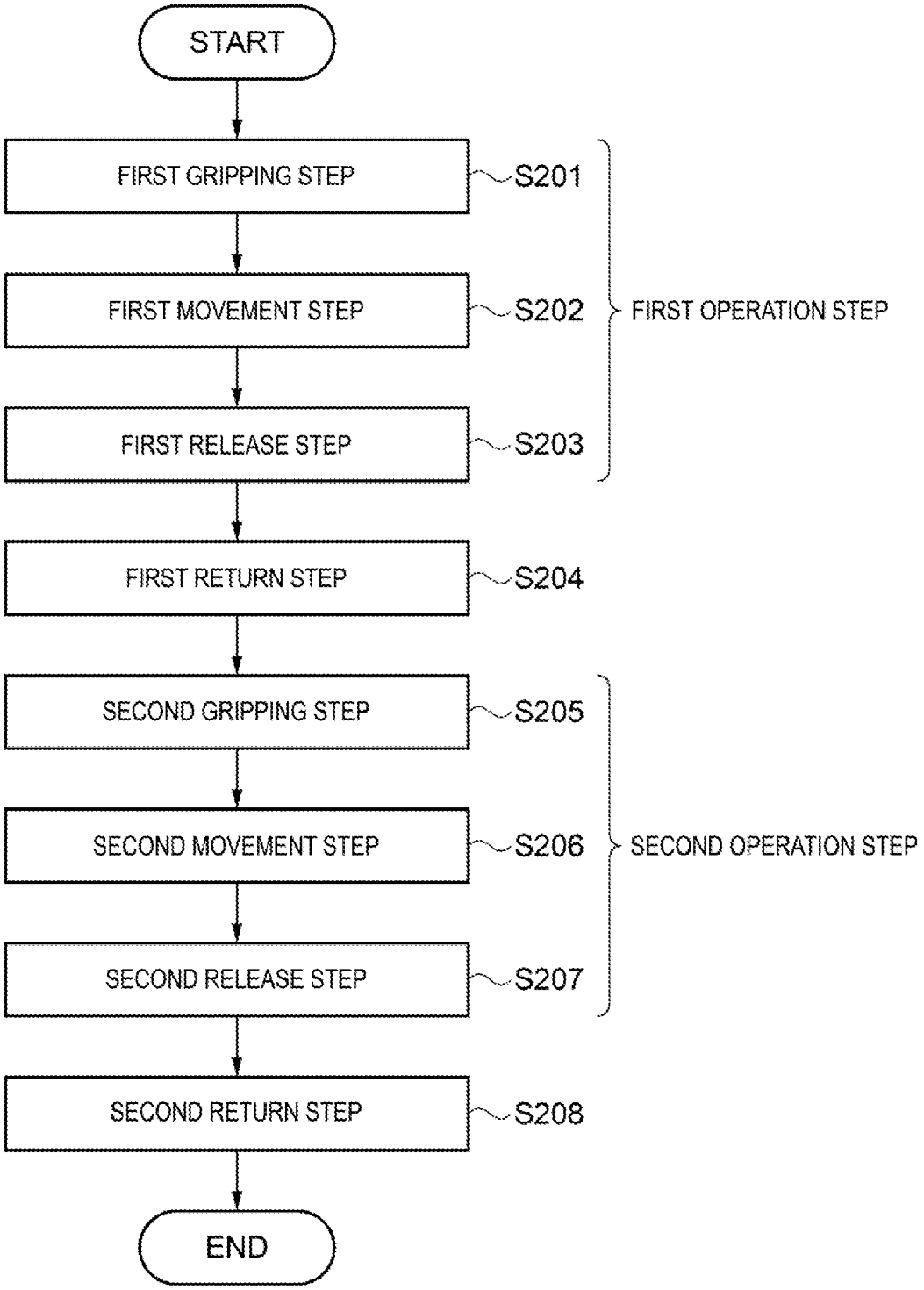
FIG. 11 is a flowchart diagram illustrating a transporting method of the transporting belt in unidirectional printing.
Figure 12:
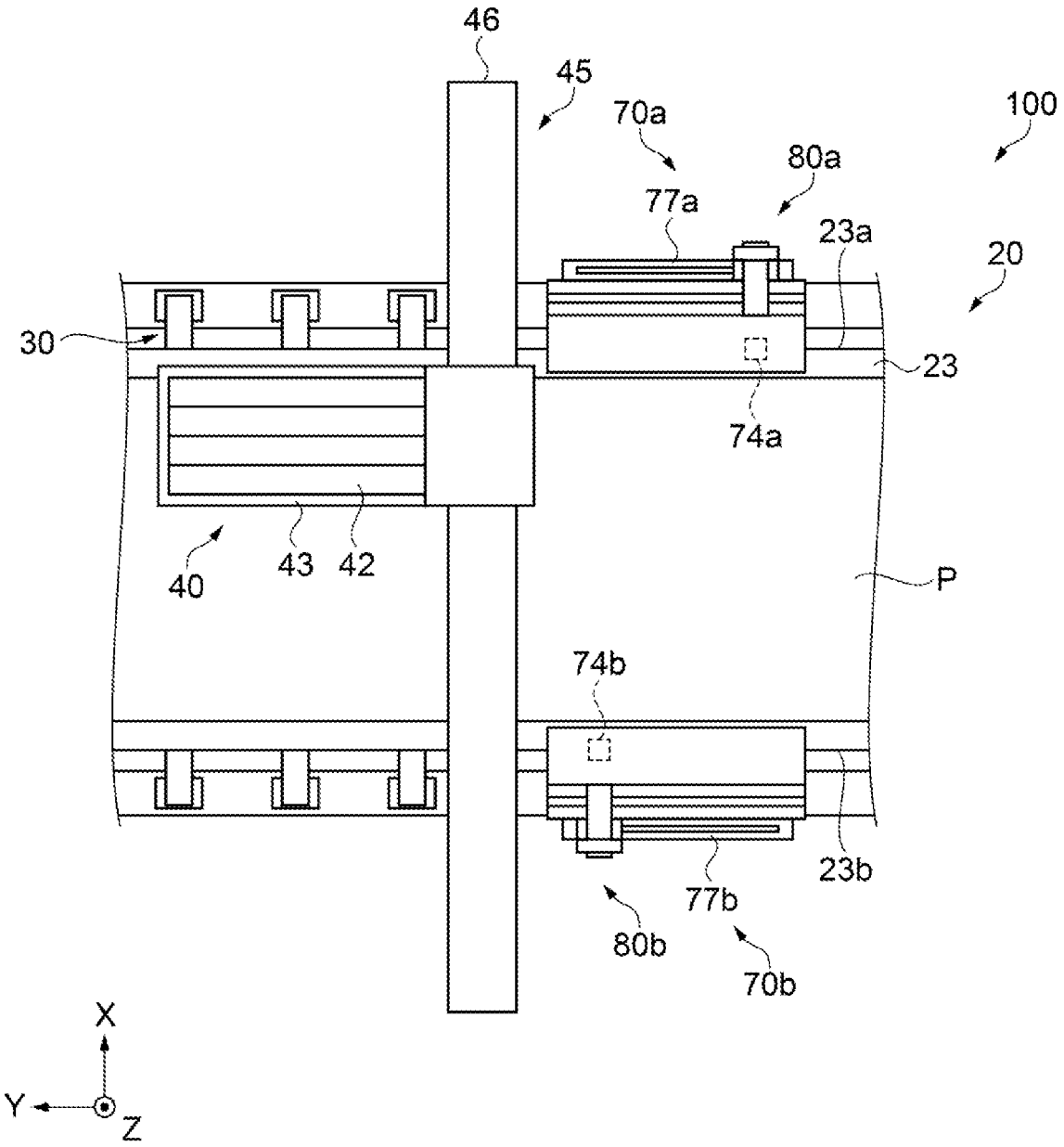
FIG. 12 is a diagram illustrating a positional relationship between the gripping portion and the head in each step of the transporting method.

FIG. 11 is a flowchart diagram illustrating the transporting method of the transporting belt in the unidirectional printing. FIG. 12 is a diagram illustrating a positional relationship between the gripping portion and the head in each step of the transporting method. Next, the transporting method of the transporting belt 23 in the unidirectional printing of the liquid ejecting device 100 will be described with reference to FIGS. 7 to 12. Note that step S201 to step S204 are the same as step S101 to step S104 of the transporting method in the above-described bidirectional printing, and thus the description will be omitted.

Step S205 is a second gripping step of gripping the transporting belt 23 by the second gripping portion 80*b*. As illustrated in FIG. 9, when the head 42 is positioned outside the transporting belt 23 with respect to the first end portion 23*a* in the width direction, the control unit 1 generates the magnetic force in the second switching unit 74*b*, and brings the second gripping portion 80*b* in the non-gripping state into the gripping state of gripping the second end portion 23*b* of the transporting belt 23. At this time, a micro vibration in the up-and-down direction is excited on the transporting belt 23 from the second end portion 23*b*.

Note that, in step S205, the control unit 1 controls the carriage moving unit 45, and the carriage 43 starts to move from the first end portion 23*a* side to the second end portion 23*b* side of the transporting belt 23.

Step S206 is a second movement step of moving the second gripping portion 80*b* in the gripping state in the transport direction. As illustrated in FIG. 12, the control unit 1 drives the second movement mechanism 77*b*, and moves the second gripping portion 80*b* in the gripping state of gripping the transporting belt 23 from upstream to downstream in the transport direction to a predetermined position. The transporting belt 23 is transported in the transport direction together with the second gripping portion 80*b*, and the medium P on the transporting belt 23 is transported to a predetermined position based on the print data.

Step S207 is a second release step of releasing the gripped second gripping portion 80*b*. The control unit 1 demagnetizes the magnetic force of the second switching unit 74*b*, and brings the second gripping portion 80*b* in the gripping state into the non-gripping state in which the transporting belt 23 is not gripped. At this time, a micro vibration in the up-and-down direction is excited on the transporting belt 23 from the second end portion 23*b*.

Note that, as illustrated in FIG. 12, the control unit 1 completes the execution of step S206 and step S207 before the head 42 mounted on the carriage 43 reaches the second end portion 23*b* side that is the printing start position of the image forming operation performed in step S208, that is, when the head 42 is positioned away from the second end portion 23*b*.

Further, step S205 to step S207 are a second operation step of performing the second operation in which the second gripping portion 80*b* grips the transporting belt 23 and moves to the predetermined position, and releases the gripped transporting belt 23.

Step S208 is a second return step of moving the second gripping portion 80*b* in the non-gripping state in the direction opposite to the transport direction. As illustrated in FIG. 7, the control unit 1 drives the second movement mechanism 77*b*, and moves the second gripping portion 80*b* in the non-gripping state from the downstream to the upstream in the transport direction to the original position.

Note that, in step S208, the control unit 1 terminates the movement of the carriage 43 toward the second end portion 23*b* side, and causes the head 42 to be positioned at the printing start position. Then, the control unit 1 controls the head 42 and the carriage moving unit 45 based on the print data, and performs the image forming operation of causing the head 42 to eject the liquid while moving the carriage 43 from the second end portion 23*b* side to the first end portion 23*a* side of the transporting belt 23. Furthermore, the control unit 1 controls the carriage moving unit 45, moves the carriage 43 from the first end portion 23*a* side of the transporting belt 23 illustrated in FIG. 9 to the second end portion 23*b* side illustrated in FIG. 7, and returns the head 42 to the printing start position of the next image forming operation.

As illustrated in FIG. 12, the micro vibration generated in step S205 and step S207 is excited at the second end portion 23*b* when the head 42 is located at the position away from the second end portion 23*b* that is the printing start position of the image forming operation. The micro vibration propagating through the transporting belt 23 is attenuated until the head 42 reaches the printing start position and starts to print.

Step S201 to step S208 are repeatedly performed, and the first operation by the first gripping portion 80*a* and the second operation by the second gripping portion 80*b* are alternately performed, and thus the transporting belt 23 is sequentially transported in the transport direction. The control unit 1 sequentially performs the image forming operation by the unidirectional printing on the medium P transported by the transporting belt 23, and thus a desired image is formed on the medium P.

As described above, according to the liquid ejecting device 100 and the transporting method of the transporting belt 23 in Exemplary Embodiment 1, the following effects can be obtained.

The liquid ejecting device 100 includes the first gripping portion 80*a* capable of gripping the first end portion 23*a* of the transporting belt 23, and the second gripping portion 80*b* capable of gripping the second end portion 23*b* of the transporting belt 23. When the head 42 is positioned outside the transporting belt 23 with respect to the second end portion 23*b*, the first gripping portion 80*a* performs the first operation of gripping the first end portion 23*a* of the transporting belt 23 and moving the transporting belt 23 in the transport direction, and releasing the gripped transporting belt 23. When the head 42 is positioned outside the transporting belt 23 with respect to the first end portion 23*a*, the second gripping portion 80*b* performs the second operation of gripping the second end portion 23*b* of the transporting belt 23 and moving the transporting belt 23 in the transport direction, and releasing the gripped transporting belt 23. In the first operation and the second operation, the first gripping portion 80*a* or the second gripping portion 80*b* grips the end portion away from the position of the head 42 and releases gripping. A micro vibration in the up-and-down direction generated when the first gripping portion 80*a* or the second gripping portion 80*b* grips the transporting belt 23 or releases gripping is excited at the end portion away from the position of the head 42. As a result, the vibration propagating through the transporting belt 23 is attenuated before the printing start position is reached or before printing starts, and thus the quality of an image printed on the medium P improves. Therefore, the liquid ejecting device 100 that improves image quality can be provided.

The liquid ejecting device 100 transports the transporting belt 23, based on a detection result of the first detection unit 85*a* configured to detect a displacement of the first gripping portion 80*a* and a detection result of the second detection unit 85*b* configured to detect a displacement of the second gripping portion 80*b*. Specifically, the first movement mechanism 77*a* of the first gripping portion 80*a* configured to move the transporting belt 23 in the transport direction is subjected to feedback control based on a detection result of the first detection unit 85*a*. The second movement mechanism 77*b* of the second gripping portion 80*b* configured to move the transporting belt 23 in the transport direction is subjected to feedback control based on a detection result of the second detection unit 85*b*. As a result, the transport accuracy of the transporting belt 23 improves.

The liquid ejecting device 100 transports the transporting belt 23 in the transport direction by alternately performing the first operation by the first gripping portion 80*a* and the second operation by the second gripping portion 80*b*. In this way, even when a length of the transporting belt 23 along the first end portion 23*a* of the 23 of the transporting belt 23 and a length of the transporting belt 23 along the second end portion 23*b* of the transporting belt 23 are slightly different, a difference between the displacement on the first end portion 23*a* side and the displacement on the second end portion 23*b* side is less likely to be generated. As a result, the transport accuracy of the transporting belt 23 improves.

The transporting method of the transporting belt 23 performs the first operation step in which, when the head 42 is positioned outside the transporting belt 23 with respect to the second end portion 23*b*, the first gripping portion 80*a* grips the first end portion 23*a* of the transporting belt 23 and moves the transporting belt 23 in the transport direction, and releases the gripped transporting belt 23. Further, the transporting method of the transporting belt 23 performs the second operation step in which, when the head 42 is positioned outside the transporting belt 23 with respect to the first end portion 23*a*, the second gripping portion 80*b* grips the second end portion 23*b* of the transporting belt 23 and moves the transporting belt 23 in the transport direction, and releases the gripped transporting belt 23. In the first operation step and the second operation step, the first gripping portion 80*a* or the second gripping portion 80*b* grips the end portion away from the position of the head 42 and releases gripping. Since a micro vibration in the up-and-down direction generated when the first gripping portion 80*a* or the second gripping portion 80*b* grips the transporting belt 23 or releases gripping is excited at the end portion on the opposite side away from the position of the head 42, the vibration propagating through the transporting belt 23 is attenuated before the printing start position is reached or printing starts. Accordingly, the quality of an image printed on the medium P improves. Therefore, the transporting method of the transporting belt 23 that improves image quality can be provided.

2. Exemplary Embodiment 2

Figure 13:
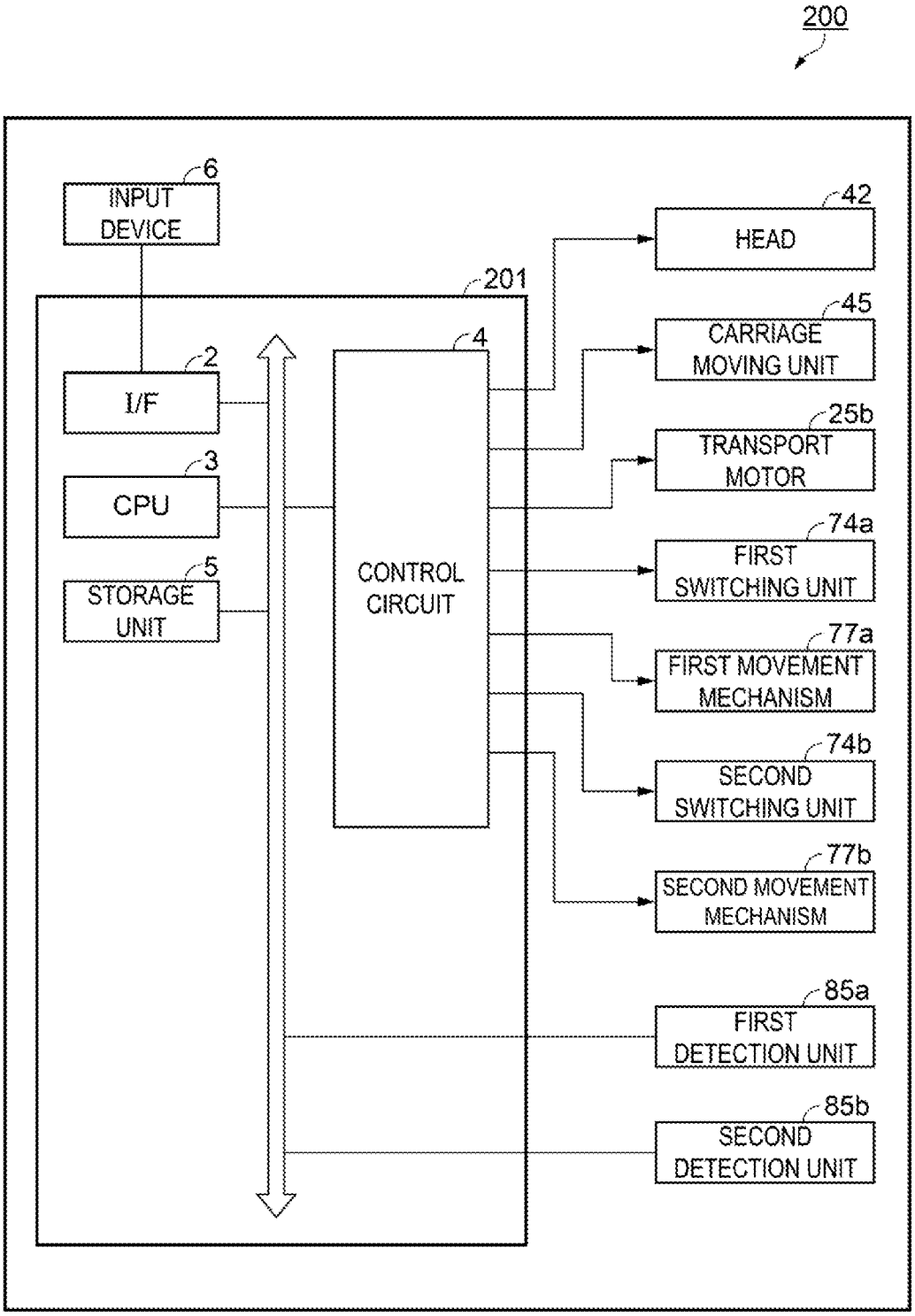
FIG. 13 is a block diagram illustrating electrical coupling of a liquid ejecting device according to Exemplary Embodiment 2.

FIG. 13 is a block diagram illustrating electrical coupling of a liquid ejecting device according to Exemplary Embodiment 2. Note that the same component as in Exemplary Embodiment 1 is given the same number, and the redundant description of the component will be omitted. Exemplary Embodiment 1 exemplifies the liquid ejecting device 100 having the configuration in which the first and second gripping portions 80*a* and 80*b* that grip the transporting belt 23 transport the transporting belt 23 in the transport direction, thereby transporting the medium P. In a liquid ejecting device 200 in the present exemplary embodiment, the second roller 25 rotates and is driven, and the transporting belt 23 rotates, thereby transporting the medium P in the transport direction.

2-1. Configuration of Liquid Ejecting Device

The liquid ejecting device 200 includes the transport unit 20 and the printing unit 40. Each of the units of the liquid ejecting device 200 is attached to the frame 10.

The first roller 24 in the present exemplary embodiment is a belt driven roller provided upstream of the printing unit 40. The second roller 25 is a belt driving roller provided downstream of the printing unit 40. The second roller 25 is provided with a transport motor 25*b* that rotates and drives the second roller 25. The transport motor 25*b* is driven, and the transporting belt 23 rotates and moves with the rotation of the second roller 25, and thus the first roller 24 is driven and rotates. In this way, the medium P supported by the transporting belt 23 is transported in the transport direction.

The first and second gripping portions 80*a* and 80*b* in the gripping state of gripping the transporting belt 23 move in the transport direction together with the transporting belt 23 that rotates and moves by a driving force of the transport motor 25*b*. The first gripping portion 80*a* in the non-gripping state moves in the direction opposite to the transport direction by the first movement mechanism 77*a*, and the second gripping portion 80*b* in the non-gripping state moves in the direction opposite to the transport direction by the second movement mechanism 77*b*.

As illustrated in FIG. 13, the liquid ejecting device 200 includes a control unit 201 that controls each component included in the liquid ejecting device 200. The control unit 201 is configured to include the I/F unit 2, the CPU 3, the control circuit 4, the storage unit 5, and the like. The CPU 3 is coupled to each component via a bus.

The control circuit 4 is a circuit coupled to the transport motor 25*b*, and configured to generate a control signal for controlling the driving of the transport motor 25*b*, based on the print data and the arithmetic result of the CPU 3.

The control unit 201 generates a first current control signal for controlling a driving portion that generates a magnetic force in the first switching unit 74*a*. The first switching unit 74*a* switches the first gripping portion 80*a* between the gripping state and the non-gripping state, based on the first current control signal.

The control unit 201 generates a transport motor control signal for controlling the transport motor 25*b*, based on the calculated displacement of the first gripping portion 80*a*, and performs feedback control of the transport motor 25*b*. In other words, the transporting belt 23 is transported based on a detection result of the first detection unit 85*a*. For example, the control unit 201 performs a first operation in which the first gripping portion 80*a* grips the transporting belt 23 and moves with the transporting belt 23 to a predetermined position in the transport direction, and releases the gripped transporting belt 23 by the control of the first switching unit 74*a* by the first current control signal and the control of the transport motor 25*b* by the transport motor control signal.

The control unit 201 generates a second current control signal for controlling a driving portion that generates a magnetic force in the second switching unit 74*b*. The second switching unit 74*b* switches the second gripping portion 80*b* between the gripping state and the non-gripping state, based on the second current control signal.

The control unit 201 generates a transport motor control signal for controlling the transport motor 25*b*, based on the calculated displacement of the second gripping portion 80*b*, and performs feedback control of the transport motor 25*b*. In other words, the transporting belt 23 is transported based on a detection result of the second detection unit 85*b*. For example, the control unit 201 performs a second operation in which the second gripping portion 80*b* grips the transporting belt 23 and moves with the transporting belt 23 to a predetermined position in the transport direction, and releases the gripped transporting belt 23 by the control of the second switching unit 74*b* by the second current control signal and the control of the transport motor 25*b* by the transport motor control signal.

The control unit 201 performs an image forming operation of generating a head control signal for controlling the driving portion of the head 42 and a carriage control signal for controlling the driving portion of the carriage moving unit 45, and ejecting the liquid droplet to the medium P by causing the head 42 moved by the carriage 43 to eject the liquid.

The control unit 201 causes the movement of the transporting belt 23 in the transport direction and the image forming operation to be alternately performed, and thus an image based on the image data is printed on the medium P.

2-2. Transporting Method in Bidirectional Printing

Figure 14:
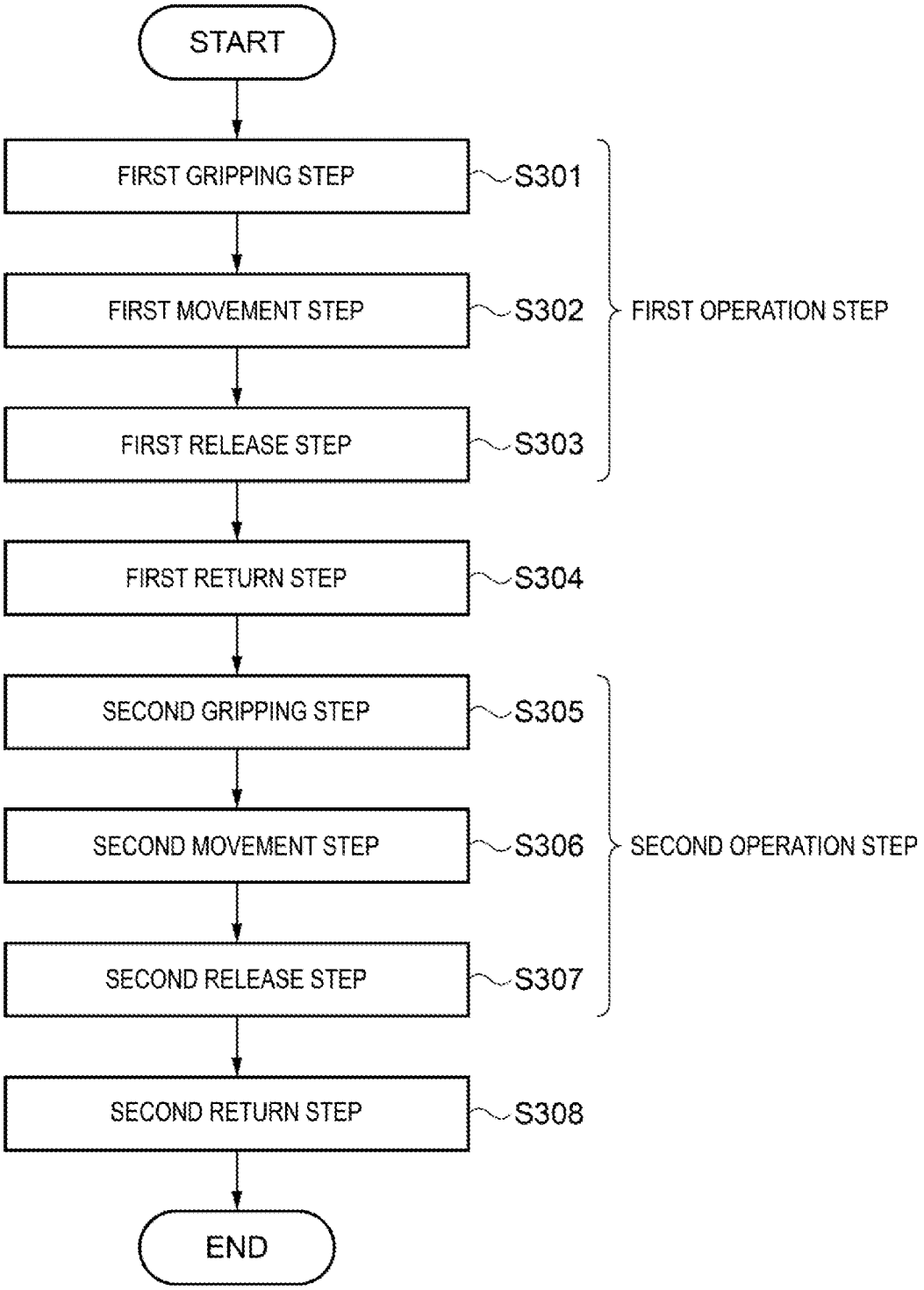
FIG. 14 is a flowchart diagram illustrating a transporting method of the transporting belt in bidirectional printing.

FIG. 14 is a flowchart diagram illustrating the transporting method of the transporting belt in the bidirectional printing. The transporting method of the transporting belt 23 in the bidirectional printing of the liquid ejecting device 200 will be described.

Step S301 is the same as step S101 described in Exemplary Embodiment 1, except that step 301 is performed by the control unit 201 instead of the control unit 1, and thus the description will be omitted. In step S301, a micro vibration in the up-and-down direction is excited on the transporting belt 23 from the first end portion 23*a* gripped by the first gripping portion 80*a*.

Step S302 is a first movement step of moving the first gripping portion 80*a* in the gripping state in the transport direction. The control unit 201 drives the transport motor 25*b*, and moves the transporting belt 23 in the transport direction. In this way, as illustrated in FIG. 8, the first gripping portion 80*a* in the gripping state of gripping the transporting belt 23 moves from upstream to downstream in the transport direction. The transporting belt 23 is transported in the transport direction based on a detection result of the first detection unit 85*a*, and the medium P on the transporting belt 23 is transported to a predetermined position based on print data.

Step S303 is the same as step S103 described in Exemplary Embodiment 1, except that step S303 is performed by the control unit 201 instead of the control unit 1, and thus the description will be omitted. In step S303, a micro vibration in the up-and-down direction is excited on the transporting belt 23 from the first end portion 23*a* that has been gripped by the first gripping portion 80*a*.

Note that step S301 to step S303 are a first operation step of performing the first operation in which the first gripping portion 80*a* grips the transporting belt 23 and moves to the predetermined position, and releases the gripped transporting belt 23.

Step S304 is the same as step S104 described in Exemplary Embodiment 1, except that step S304 is performed by the control unit 201 instead of the control unit 1, and thus the description will be omitted.

Note that, in step S304, the control unit 201 controls the head 42 and the carriage moving unit 45 based on the print data, and performs the image forming operation of causing the head 42 to eject the liquid while moving the carriage 43 from the second end portion 23*b* side to the first end portion 23*a* side of the transporting belt 23. The image forming operation may start simultaneously with step S303 or may start between step S304 and step S305. As illustrated in FIG. 8, the micro vibration generated in step S301 and step S303 is excited at the first end portion 23*a* away from the head 42 positioned on the second end portion 23*b* side that is the printing start position of the image forming operation. The micro vibration propagating through the transporting belt 23 is attenuated before reaching the printing start position.

Step S305 is the same as step S105 described in Exemplary Embodiment 1, except that step S305 is performed by the control unit 201 instead of the control unit 1, and thus the description will be omitted. In step S305, a micro vibration in the up-and-down direction is excited on the transporting belt 23 from the second end portion 23*b* gripped by the second gripping portion 80*b*.

Step S306 is a second movement step of moving the second gripping portion 80*b* in the gripping state in the transport direction. The control unit 201 drives the transport motor 25*b*, and moves the transporting belt 23 in the transport direction. In this way, as illustrated in FIG. 10, the second gripping portion 80*b* in the gripping state of gripping the transporting belt 23 moves from upstream to downstream in the transport direction. The transporting belt 23 is transported in the transport direction based on a detection result of the second detection unit 85*b*, and the medium P on the transporting belt 23 is transported to a predetermined position based on the print data.

Step S307 is the same as step S107 described in Exemplary Embodiment 1, except that step S307 is performed by the control unit 201 instead of the control unit 1, and thus the description will be omitted.

Note that step S305 to step S307 are a second operation step of performing the second operation in which the second gripping portion 80*b* grips the transporting belt 23 and moves to the predetermined position, and releases the gripped transporting belt 23.

Step S308 is the same as step S108 described in Exemplary Embodiment 1, except that step S308 is performed by the control unit 201 instead of the control unit 1, and thus the description will be omitted.

Note that, in step S308, the control unit 201 controls the head 42 and the carriage moving unit 45 based on the print data, and performs the image forming operation of causing the head 42 to eject the liquid while moving the carriage 43 from the first end portion 23*a* side to the second end portion 23*b* side of the transporting belt 23. The image forming operation may start simultaneously with step S307 or may start between step S308 and step S301 when step S301 to step S308 are repeatedly performed. As illustrated in FIG. 9, the micro vibration generated in step S305 and step S307 is excited at the second end portion 23*b* away from the head 42 positioned on the first end portion 23*a* side that is the printing start position of the image forming operation. The micro vibration propagating through the transporting belt 23 is attenuated before reaching the printing start position.

By repeatedly performing from step S301 to step S308, the transporting belt 23 is sequentially transported in the transport direction, and the first operation by the first gripping portion 80*a* and the second movement by the second gripping portion 80*b* are alternately performed. The control unit 201 sequentially performs the image forming operation by the bidirectional printing on the medium P transported by the transporting belt 23, and thus a desired image is formed on the medium P.

2-3. Transporting Method in Unidirectional Printing

Figure 15:
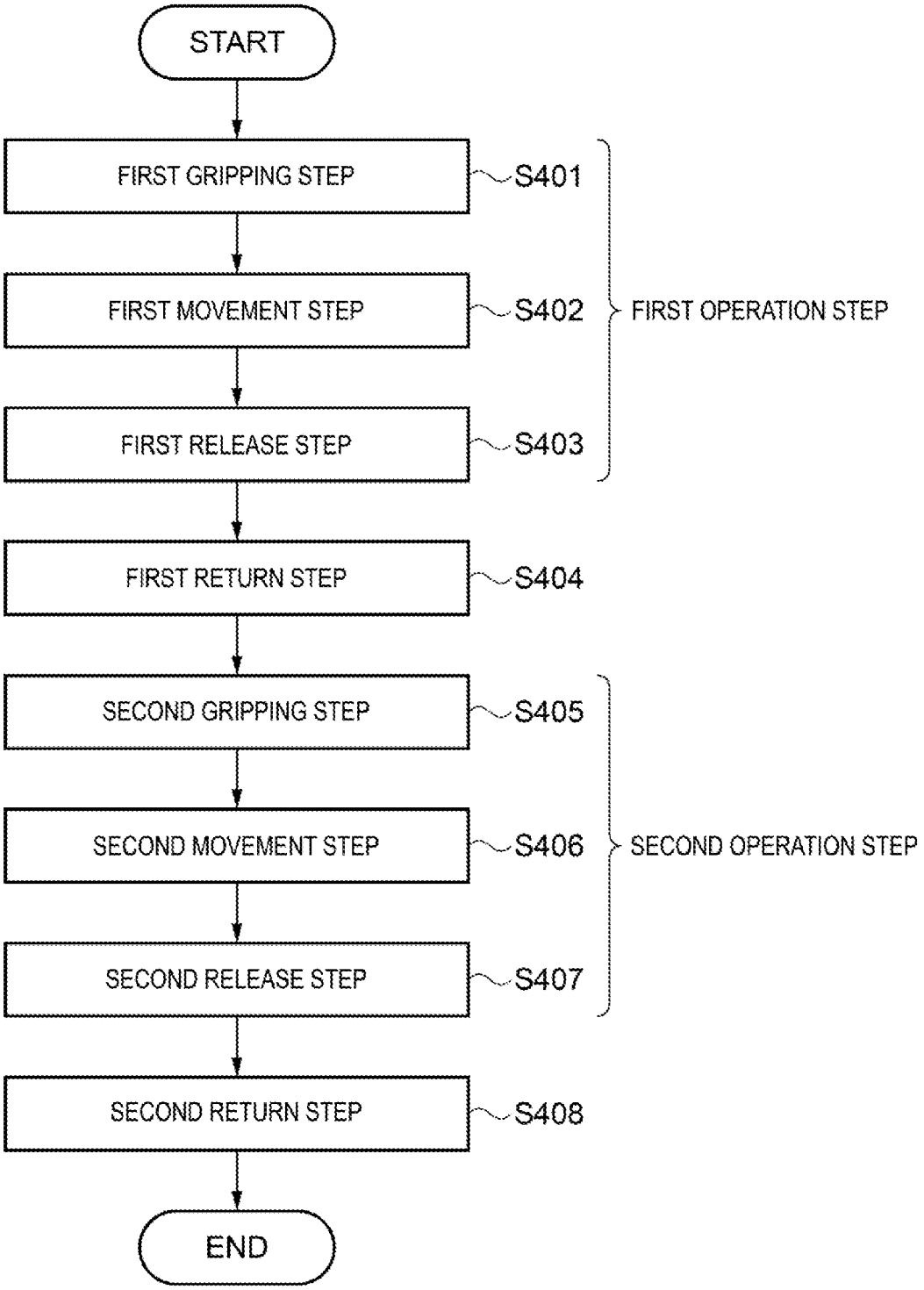
FIG. 15 is a flowchart diagram illustrating a transporting method of the transporting belt in unidirectional printing.

FIG. 15 is a flowchart diagram illustrating the transporting method of the transporting belt in the unidirectional printing. The transporting method of the transporting belt 23 in the unidirectional printing of the liquid ejecting device 200 will be described. Note that step S401 to step S404 are the same as step S301 to step S304 of the transporting method in the above-described bidirectional printing, and thus the description will be omitted.

Step S405 is the same as step S205 described in Exemplary Embodiment 1, except that step S405 is performed by the control unit 201 instead of the control unit 1, and thus the description will be omitted. In step S405, a micro vibration in the up-and-down direction is excited on the transporting belt 23 from the second end portion 23*b*.

Note that, in step S405, the control unit 201 controls the carriage moving unit 45, and the carriage 43 starts to move from the first end portion 23*a* side to the second end portion 23*b* side of the transporting belt 23.

Step S406 is a second movement step of moving the second gripping portion 80*b* in the gripping state in the transport direction. The control unit 201 drives the transport motor 25*b*, and moves the transporting belt 23 in the transport direction. In this way, as illustrated in FIG. 12, the second gripping portion 80*b* in the gripping state of gripping the transporting belt 23 moves from upstream to downstream in the transport direction. The transporting belt 23 is transported in the transport direction based on a detection result of the second detection unit 85*b*, and the medium P on the transporting belt 23 is transported to a predetermined position based on the print data.

Step S407 is the same as step S207 described in Exemplary Embodiment 1, except that step S407 is performed by the control unit 201 instead of the control unit 1, and thus the description will be omitted. In step S407, a micro vibration in the up-and-down direction is excited on the transporting belt 23 from the second end portion 23*b*.

Note that, as illustrated in FIG. 12, the control unit 201 completes the execution of step S406 and step S407 before the head 42 mounted on the carriage 43 reaches the second end portion 23*b* side that is the printing start position of the image forming operation performed in step S408, that is, when the head 42 is positioned away from the second end portion 23*b*.

Further, step S405 to step S407 are a second operation step of performing the second operation in which the second gripping portion 80*b* grips the transporting belt 23 and moves to the predetermined position, and releases the gripped transporting belt 23.

Step S408 is the same as step S208 described in Exemplary Embodiment 1, except that step S408 is performed by the control unit 201 instead of the control unit 1, and thus the description will be omitted.

Note that, in step S408, the control unit 201 terminates the movement of the carriage 43 toward the second end portion 23*b* side, and causes the head 42 to be positioned at the printing start position. Then, the control unit 201 controls the head 42 and the carriage moving unit 45 based on the print data, and performs the image forming operation of causing the head 42 to eject the liquid while moving the carriage 43 from the second end portion 23*b* side to the first end portion 23*a* side of the transporting belt 23. Furthermore, the control unit 201 controls the carriage moving unit 45, moves the carriage 43 from the first end portion 23*a* side of the transporting belt 23 illustrated in FIG. 9 to the second end portion 23*b* side illustrated in FIG. 7, and returns the head 42 to the printing start position of the next image forming operation.

As illustrated in FIG. 12, the micro vibration generated in step S405 and step S407 is excited at the second end portion 23*b* when the head 42 is located at the position away from the second end portion 23*b* that is the printing start position of the image forming operation. The micro vibration propagating through the transporting belt 23 is attenuated until the head 42 reaches the printing start position and starts to print.

By repeatedly performing from step S401 to step S408, the transporting belt 23 is sequentially transported in the transport direction, and the first operation by the first gripping portion 80*a* and the second movement by the second gripping portion 80*b* are alternately performed. The control unit 201 sequentially performs the image forming operation by the unidirectional printing on the medium P transported by the transporting belt 23, and thus a desired image is formed on the medium P.

As described above, according to the liquid ejecting device 200 and the transporting method of the transporting belt 23 in Exemplary Embodiment 2, the following effects can be obtained.

The liquid ejecting device 200 includes the first gripping portion 80*a* capable of gripping the first end portion 23*a* of the transporting belt 23, and the second gripping portion 80*b* capable of gripping the second end portion 23*b* of the transporting belt 23. When the head 42 is positioned outside the transporting belt 23 with respect to the second end portion 23*b*, the first gripping portion 80*a* performs the first operation of gripping the first end portion 23*a* of the transporting belt 23 and moving with the transporting belt 23 in the transport direction, and releasing the gripped transporting belt 23. When the head 42 is positioned outside the transporting belt 23 with respect to the first end portion 23*a*, the second gripping portion 80*b* performs the second operation of gripping the second end portion 23*b* of the transporting belt 23 and moving with the transporting belt 23 in the transport direction, and releasing the gripped transporting belt 23. In the first operation and the second operation, the first gripping portion 80*a* or the second gripping portion 80*b* grips the end portion away from the position of the head 42 and releases gripping. A micro vibration in the up-and-down direction generated when the first gripping portion 80*a* or the second gripping portion 80*b* grips the transporting belt 23 or releases gripping is excited at the end portion away from the position of the head 42. As a result, the vibration propagating through the transporting belt 23 is attenuated before the printing start position is reached or before printing starts, and thus the quality of an image printed on the medium P improves. Therefore, the liquid ejecting device 200 that improves image quality can be provided.

The liquid ejecting device 200 transports the transporting belt 23, based on a detection result of the first detection unit 85*a* configured to detect a displacement of the first gripping portion 80*a* and a detection result of the second detection unit 85*b* configured to detect a displacement of the second gripping portion 80*b*. Specifically, the transport motor 25*b* that moves the transporting belt 23 in the transport direction is subjected to feedback control based on a detection result of the first detection unit 85*a* or the second detection unit 85*b*, and thus the transport accuracy of the transporting belt 23 improves.

The liquid ejecting device 200 alternately performs the first operation by the first gripping portion 80*a* and the second operation by the second gripping portion 80*b* on the transporting belt 23 transported in the transport direction. In this way, even when a length of the transporting belt 23 along the first end portion 23*a* of the 23 of the transporting belt 23 and a length of the transporting belt 23 along the second end portion 23*b* of the transporting belt 23 are slightly different, a difference between the displacement on the first end portion 23*a* side and the displacement on the second end portion 23*b* side is less likely to be generated. As a result, the transport accuracy of the transporting belt 23 improves.

The transporting method of the transporting belt 23 performs the first operation step in which, when the head 42 is positioned outside the transporting belt 23 with respect to the second end portion 23*b*, the first gripping portion 80*a* grips the first end portion 23*a* of the transporting belt 23 and moves with the transporting belt 23, and releases the gripped transporting belt 23. Further, the transporting method of the transporting belt 23 performs the second operation step in which, when the head 42 is positioned outside the transporting belt 23 with respect to the first end portion 23*a*, the second gripping portion 80*b* grips the second end portion 23*b* of the transporting belt 23 and moves with the transporting belt 23, and releases the gripped transporting belt 23. In the first operation step and the second operation step, the first gripping portion 80*a* or the second gripping portion 80*b* grips the end portion away from the position of the head 42 and releases gripping. Since a micro vibration in the up-and-down direction generated when the first gripping portion 80*a* or the second gripping portion 80*b* grips the transporting belt 23 or releases gripping is excited at the end portion on the opposite side away from the position of the head 42, the vibration propagating through the transporting belt 23 is attenuated before the printing start position is reached or printing starts. Accordingly, the quality of an image printed on the medium P improves. Therefore, the transporting method of the transporting belt 23 that improves image quality can be provided.

Contents derived from the exemplary embodiments will be described below.

A liquid ejecting device includes a transporting belt configured to transport a medium in a transport direction, a head configured to move between a first end portion and a second end portion of the transporting belt in a width direction that intersects the transport direction, and eject a liquid onto the medium, a first gripping portion configured to grip the first end portion of the transporting belt, and move in the transport direction, and a second gripping portion configured to grip the second end portion of the transporting belt, and move in the transport direction, where, when the head is positioned outside the transporting belt with respect to the second end portion in the width direction, the first gripping portion performs a first operation of gripping the transporting belt and moving to a predetermined position, and releasing the gripped transporting belt, and, when the head is positioned outside the transporting belt with respect to the first end portion in the width direction, the second gripping portion performs a second operation of gripping the transporting belt and moving to a predetermined position, and releasing the gripped transporting belt.

According to the configuration, when the head is positioned outside the transporting belt with respect to the second end portion, the first gripping portion that grips the first end portion of the transporting belt performs the first operation. When the head is positioned outside the transporting belt with respect to the first end portion, the second gripping portion that grips the second end portion of the transporting belt performs the second operation. In the first operation and the second operation, a micro vibration generated when the first gripping portion or the second gripping portion grips the transporting belt or releases gripping is excited at the end portion away from the position of the head. As a result, the vibration propagating through the transporting belt is attenuated before the head reaches a position at which ejection of the liquid starts or before the head starts to eject the liquid, and thus the quality of an image printed on the medium improves. Therefore, the liquid ejecting device that improves image quality can be provided.

The liquid ejecting device described above may further include a first detection unit configured to detect a displacement of the first gripping portion, and a second detection unit configured to detect a displacement of the second gripping portion, where the first gripping portion may perform the first operation, based on a detection result of the first detection unit, and the transporting belt may be transported based on a detection result of the first detection unit or the second detection unit.

According to the configuration, the transporting belt is moved in the transport direction, based on a detection result of the first detection unit configured to detect a displacement of the first gripping portion that grips the transporting belt or the second detection unit configured to detect a displacement of the second gripping portion that grips the transporting belt. As a result, the transport accuracy of the transporting belt improves.

In the liquid ejecting device described above, the first operation and the second operation may be alternately performed.

According to the configuration, the transporting belt is alternately transported by the first gripping portion and the second gripping portion. As a result, a difference between the displacement on the first end portion side of the transporting belt and the displacement on the second end portion side of the transporting belt is less likely to be generated, and thus the transport accuracy of the transporting belt improves.

A transporting method of a transporting belt is a transporting method of a transporting belt of a liquid ejecting device including the transporting belt configured to transport a medium in a transport direction, a head configured to move between a first end portion and a second end portion of the transporting belt in a width direction that intersects the transport direction, and eject a liquid onto the medium supported by the transporting belt, a first gripping portion configured to grip the first end portion of the transporting belt, and move in the transport direction, and a second gripping portion configured to grip the second end portion of the transporting belt, and move in the transport direction, and includes a first operation step in which, when the head is positioned outside the transporting belt with respect to the second end portion in the width direction, the first gripping portion grips the transporting belt and moves to a predetermined position, and releases the gripped transporting belt, and a second operation step in which, when the head is positioned outside the transporting belt with respect to the first end portion in the width direction, the second gripping portion grips the transporting belt and moves to a predetermined position, and releases the gripped transporting belt.

According to the method, when the head is positioned outside the transporting belt with respect to the second end portion, the first operation step is performed, and the first gripping portion that grips the first end portion of the transporting belt transports the transporting belt in the transport direction. When the head is positioned outside the transporting belt with respect to the first end portion, the second operation step is performed, and the second gripping portion that grips the second end portion of the transporting belt transports the transporting belt in the transport direction. In the first operation step and the second operation step, a micro vibration generated when the first gripping portion or the second gripping portion grips the transporting belt or releases gripping is excited at the end portion away from the position of the head. As a result, the vibration propagating through the transporting belt is attenuated before the head reaches a position at which ejection of the liquid starts or before the head starts to eject the liquid, and thus the quality of an image printed on the medium improves. Therefore, the transporting method of the transporting belt that improves image quality can be provided.

What is claimed is:

1. A liquid ejecting device, comprising:

a transporting belt configured to transport a medium in a transport direction;

a head configured to move between a first end portion and a second end portion of the transporting belt in a width direction that intersects the transport direction, and eject a liquid onto the medium;

a first gripping portion configured to grip the first end portion of the transporting belt, and move in the transport direction; and a second gripping portion configured to grip the second end portion of the transporting belt, and move in the transport direction, wherein, when the head is positioned outside the transporting belt with respect to the second end portion in the width direction, the first gripping portion performs a first operation of gripping the transporting belt and moving to a predetermined position, and releasing the gripped transporting belt, and, when the head is positioned outside the transporting belt with respect to the first end portion in the width direction, the second gripping portion performs a second operation of gripping the transporting belt and moving to a predetermined position, and releasing the gripped transporting belt.

2. The liquid ejecting device according to claim 1, further comprising:

a first detection unit configured to detect a displacement of the first gripping portion; and a second detection unit configured to detect a displacement of the second gripping portion, wherein the transporting belt is transported based on a detection result of the first detection unit or the second detection unit.

3. The liquid ejecting device according to claim 1, wherein the first operation and the second operation are alternately performed.

4. The liquid ejecting device according to claim 1, wherein the first gripping portion includes a first magnetic member and a first elastic member, the actuation of the first magnetic member causing the first elastic member to grip the first end portion, and the second gripping portion includes a second magnetic member and a second elastic member, the actuation of the second magnetic member causing the second elastic member to grip the second end portion.

5. A transporting method of a transporting belt of a liquid ejecting device including the transporting belt configured to transport a medium in a transport direction, a head configured to move between a first end portion and a second end portion of the transporting belt in a width direction that intersects the transport direction, and eject a liquid onto the medium supported by the transporting belt, a first gripping portion configured to grip the first end portion of the transporting belt, and move in the transport direction, and a second gripping portion configured to grip the second end portion of the transporting belt, and move in the transport direction, the transporting method comprising:

a first operation step in which, when the head is positioned outside the transporting belt with respect to the second end portion in the width direction, the first gripping portion grips the transporting belt and moves to a predetermined position, and releases the gripped transporting belt; and a second operation step in which, when the head is positioned outside the transporting belt with respect to the first end portion in the width direction, the second gripping portion grips the transporting belt and moves to a predetermined position, and releases the gripped transporting belt.

6. The liquid ejecting device according to claim 5, wherein the first gripping portion includes a first magnetic member and a first elastic member, the actuation of the first magnetic member causing the first elastic member to grip the first end portion, and the second gripping portion includes a second magnetic member and a second elastic member, the actuation of the second magnetic member causing the second elastic member to grip the second end portion.

* * * * *